US005534063A

United States Patent [19]

Maruyama et al.

[11] Patent Number: 5,534,063

[45] Date of Patent: Jul. 9, 1996

[54] APPARATUS FOR REMOVING IMAGE FORMING SUBSTANCE FROM SHEET AND SHEET PROCESSING APPARATUS

[75] Inventors: Tooru Maruyama, Fujisawa; Iwao Takahashi, Yokosuka; Masatoshi Saito; Shigeru Fujita, both of Tokyo; Hisao Watanabe; Taro Terashi, both of Sagamihara; Tomoaki Sugawara, Warabi; Masaru Shinkai, Yokohama; Toshiyuki Kawanishi; Masato Igarashi, both of Numazu, all of Japan

[73] Assignee: Ricoh Company, Ltd., Tokyo, Japan

[21] Appl. No.: 277,267

[22] Filed: Jul. 21, 1994

[30] Foreign Application Priority Data

| | | | |
|---|---|---|---|
| Jul. 21, 1993 | [JP] | Japan | 5-201172 |
| Jul. 21, 1993 | [JP] | Japan | 5-201173 |
| Jul. 21, 1993 | [JP] | Japan | 5-201174 |
| Jul. 21, 1993 | [JP] | Japan | 5-201175 |
| Jul. 21, 1993 | [JP] | Japan | 5-201176 |
| Jul. 21, 1993 | [JP] | Japan | 5-201178 |
| Jul. 21, 1993 | [JP] | Japan | 5-201179 |

[51] Int. Cl.[6] ..... B05C 1/00

[52] U.S. Cl. ..... 118/60; 118/686; 118/712; 118/101; 118/106; 118/109; 118/118; 118/123; 118/236; 118/264

[58] Field of Search ..... 118/676, 686, 118/712, 60, 101, 106, 109, 118, 123, 236, 264, 652; 355/296; 15/256.51, 256.52, 102; 198/840; 430/126

[56] References Cited

U.S. PATENT DOCUMENTS

| | | | |
|---|---|---|---|
| 207,626 | 9/1878 | Sargent | 198/840 |
| 722,252 | 3/1903 | Richards | 198/840 |
| 3,202,532 | 8/1965 | Labombarde | 118/101 |
| 3,448,720 | 6/1969 | Graham | 15/102 |
| 4,204,865 | 5/1980 | Kuehnle et al. | 430/30 |
| 4,249,653 | 2/1981 | Kufferath-Kassner | 198/840 |
| 4,273,438 | 6/1981 | Nishikawa | 355/272 |
| 4,899,872 | 2/1990 | Hokao | 198/846 |
| 4,965,640 | 10/1990 | Watarai et al. | 355/283 |
| 5,063,411 | 11/1991 | Haneda et al. | 355/296 |
| 5,215,852 | 6/1993 | Kato et al. | 430/126 |
| 5,262,259 | 11/1993 | Chou et al. | 430/47 |
| 5,353,108 | 10/1994 | Tsukamoto | 355/296 |
| 5,359,398 | 10/1994 | Echigo et al. | 118/652 |

FOREIGN PATENT DOCUMENTS

| | | |
|---|---|---|
| 50-56942 | 5/1975 | Japan . |
| 51-100728 | 9/1976 | Japan . |
| 54-27435 | 3/1979 | Japan . |
| 57-114171 | 7/1982 | Japan . |
| 57-125962 | 8/1982 | Japan . |
| 57-125963 | 8/1982 | Japan . |
| 58-105569 | 7/1983 | Japan . |
| 59-2069 | 1/1984 | Japan . |
| 59-33483 | 2/1984 | Japan . |
| 59-93764 | 5/1984 | Japan . |
| 59-89372 | 5/1984 | Japan . |
| 59-98172 | 6/1984 | Japan . |
| 60-133458 | 7/1985 | Japan . |
| 60-230899 | 11/1985 | Japan . |

(List continued on next page.)

OTHER PUBLICATIONS

Kirk–Othmer, *Encyclopedia of Chemical Technology*, 3rd Edition, vol. 6, (1979), pp. 386–426.

*Primary Examiner*—Laura Edwards
*Attorney, Agent, or Firm*—Oblon, Spivak, McClelland, Maier & Neustadt

[57] ABSTRACT

An apparatus capable of surely removing a toner or similar image forming substance stably cohered to a sheet, and an apparatus for processing a sheet are disclosed. A liquid supply unit uniformly supplies a liquid to a toner carried on the sheet. The sheet infiltrated with the liquid is heated by a toner removing unit to have to the toner thereof softened. As a result, the toner adheres to the surface of an offset member implemented as a belt or a drum. The sheet containing the liquid therein is conveyed to the toner removing unit without creasing, breaking or folding.

17 Claims, 13 Drawing Sheets

FOREIGN PATENT DOCUMENTS

| | | |
|---|---|---|
| 62-102270 | 5/1987 | Japan . |
| 62-203190 | 9/1987 | Japan . |
| 62-212187 | 9/1987 | Japan . |
| 62-199767 | 12/1987 | Japan . |
| 63-73282 | 4/1988 | Japan . |
| 63-140577 | 9/1988 | Japan . |
| 1-101576 | 4/1989 | Japan . |
| 1-101577 | 4/1989 | Japan . |
| 1-37266 | 5/1989 | Japan . |
| 1-297294 | 11/1989 | Japan . |
| 2-3400 | 1/1990 | Japan . |
| 2-11400 | 1/1990 | Japan . |
| 2-55195 | 2/1990 | Japan . |
| 2-62277 | 3/1990 | Japan . |
| 2-111987 | 4/1990 | Japan . |
| 2-227299 | 9/1990 | Japan . |
| 2-117547 | 9/1990 | Japan . |
| 3-249661 | 11/1991 | Japan . |
| 4-22968 | 1/1992 | Japan . |
| 4-64473 | 2/1992 | Japan . |
| 4-57070 | 2/1992 | Japan . |
| 4-64472 | 2/1992 | Japan . |
| 4-89271 | 3/1992 | Japan . |
| 4-67043 | 3/1992 | Japan . |
| 4-82983 | 3/1992 | Japan . |
| 4-91298 | 3/1992 | Japan . |
| 4-234056 | 8/1992 | Japan . |
| 4-281096 | 10/1992 | Japan . |
| 4-118499 | 10/1992 | Japan . |
| 4-118500 | 10/1992 | Japan . |
| 4-300395 | 10/1992 | Japan . |
| 4-327299 | 11/1992 | Japan . |
| 4-333699 | 11/1992 | Japan . |
| 4-333088 | 11/1992 | Japan . |
| 4-356089 | 12/1992 | Japan . |
| 4-356088 | 12/1992 | Japan . |
| 4-356087 | 12/1992 | Japan . |
| 4-356086 | 12/1992 | Japan . |
| 4-356085 | 12/1992 | Japan . |
| 5-2356 | 1/1993 | Japan . |
| 5-61382 | 3/1993 | Japan . |
| 5-127571 | 5/1993 | Japan . |
| 5-216374 | 8/1993 | Japan . |
| 5-216376 | 8/1993 | Japan . |
| 6-43682 | 2/1994 | Japan . |
| 6-67576 | 3/1994 | Japan . |
| 6-208318 | 7/1994 | Japan . |
| 6-206358 | 7/1994 | Japan . |

POWER ON
ROTATE FEED ROLLER PAIR 24
ROTATE OFFSET DRUM 81
ROTATE CONVEY-OR ROLLER PAIR 87
ROTATE FINISH ROLLER PAIR 66
ROTATE DIS-CHARGE ROLL-ER PAIR 65
EACH ROLLER REACHED TARGET LINEAR VELOCITY ?
N
Y
START TURNING ON LAMPS
SET TEMPERATURE ?
N
Y
N

APPARATUS FOR REMOVING IMAGE FORMING SUBSTANCE FROM SHEET AND SHEET PROCESSING APPARATUS

BACKGROUND OF THE INVENTION

The present invention relates to an apparatus capable of surely removing a toner or similar image forming substance deposited stably on a sheet by a copier, facsimile machine, printer or similar image forming equipment, and a sheet processing apparatus.

A method and an apparatus for removing a toner or similar image forming substance from a sheet, or recording, produced by image forming equipment have been proposed in various forms in the past. Among them, a toner removing method disclosed in, for example, Japanese Patent Laid-Open Publication No. 1-101576 immerses a sheet carrying a toner thereon in a solvent which dissolves the toner, or resin, and then applies ultrasonic oscillations to the sheet, thereby separating the toner from the sheet. In a method taught in Japanese Patent Laid-Open Publication No. 4-300395, a solvent is deposited on the printed portions of a waste sheet by immersion, spraying, application or similar technology so as to dissolve the toner. In this kind of method, the dissolved toner is removed by, for example, rinsing, air suction, contact with an adsorbent, mechanical or electrical separation, or electrostatic adsorption. Subsequently, the sheet is rolled or otherwise finished to be recycled.

A method not using a solvent and disclosed in, for example, Japanese Patent Laid-Open Publication No. 2-55195 removes a thermally fusible ink or toner deposited, by an electrophotographic system or a thermal transfer system, on a printing consisting of a substrate and a parting agent applied to the substrate. Specifically, this method lays an ink separating body on the printing, conveys them through between a heat roller and a press roller, and removes, after they have been cooled off, the ink separating body from the printing. As a result, the ink is transferred from the printing to the ink separating body. Japanese Patent Laid-Open Publication No. 4-64472 proposes an eraser made up of an endless sheet having at least the surface thereof implemented by a thermally fusible resin, a heat roller and a cool roller each being rotatable while supporting the endless sheet, a press roller for pressing a sheet (erasable paper), whose surface has been treated for parting, against the softened or melted resin, and a drive section for driving them. Further, Japanese Patent Laid-Open Publication No. 4-82983 proposes an image forming substance removing apparatus having two parallel rollers rotatable in contact with each other and allowing a sheet to pass through the nip portion thereof, a heater for heating at least one of the rollers, a scraper for separating the sheet moved away from the nip portion from the rollers, and a removing device for removing an image forming substance from the rollers.

Assume that an image forming substance contains a thermally fusible resin as a major component thereof, and that it is deposited by, for example, a fixing step included in an electrophotographic process on a plain paper or similar paper whose fibers appear on the surface. Then, the image forming substance firmly coheres to the fibers of the paper. Hence, if the substance is removed from the sheet by any of the conventional methods and apparatuses not using a solvent, even the fibers are stripped off the sheet together with the substance, damaging the entire sheet. Particularly, when heat and pressure are applied to the ink separating body, endless sheet or rollers in order to promote the removal of the image forming substance, the cohesion of the substance to the sheet is rather enhanced, depending on various conditions.

In light of the above, a sheet or recording may be infiltrated with at least one of water or labilizing agent, aqueous solution containing a surface active agent, aqueous solution containing a water-soluble polymer, and aqueous solution containing both a surface active agent and a water-soluble polymer. An image forming substance carried on the wet sheet is caused to adhere to an intermediary separating member by heat or pressure. As a result, the substance is removed from the sheet. This kind of scheme is taught in, for example, Japanese Patent Application No. 4-255916. With this method, it is possible to remove only the image forming substance without damaging the sheet noticeably. Of course, if the sheet from which the substance has just been removed still contains the liquid, it is not feasible for image formation using, for example, an electrophotographic copier Preferably, therefore, the sheet should be subjected to postprocessing for removing the liquid.

The postprocessing, however, brings about some problems, as follows. Assume that to evaporate the liquid, the sheet infiltrated with the liquid is conveyed by being nipped in the widthwise direction thereof by a plurality of conveying means which move at the same speed. Then, the sheet is likely to crease, tear off or fold. When the sheet is simply brought into contact with the liquid to retain it therein, it is likely that the liquid fails to infiltrate into the sheet sufficiently, preventing the image forming substance from being removed in the expected manner. Moreover, not only the image forming substance but also the fibers of the sheet are removed from the sheet, depending on the softening degree of the substance.

On the other hand, Japanese Patent Application No. 4-255915, for example, teaches a method which infiltrates a fresh sheet with a liquid selected from water, aqueous solution containing a surface active agent, aqueous solution containing a water-soluble polymer, and aqueous solution containing both a surface active agent and a water-soluble polymer, and then dries the sheet. The sheet undergone such processing is used for conventional image formation, and then the image forming substance is removed by the above-stated method for reuse. With this processing, it is also desirable to remove, after the sheet has been infiltrated with the liquid, excessive part of the liquid by heating or otherwise treating the sheet. However, this kind of treatment also brings about the crease, breakage or fold problem discussed previously. Again, when the sheet is simply brought into contact with the liquid to retain it therein, it is likely that the liquid fails to infiltrate into the sheet sufficiently, preventing the image forming substance from being removed in the expected manner. Moreover, not only the image forming substance but also the fibers of the sheet are removed from the sheet, depending on the softening degree of the substance. In addition, when the liquid is supplied to the sheet by a liquid supply member whose surface moves in an endless fashion while carrying the liquid thereon, it is likely that a sufficient amount of liquid cannot be supplied to the sheet.

Other prior art technologies relating to the present invention are listed below.

(1) Japanese Patent Laid-Open Publication No. 60-133458

(2) Japanese Patent Laid-Open Publication No. 4-22968

(3) Japanese Patent Laid-Open Publication No. 4-300395

(4) Japanese Patent Laid-Open Publication No. 4-327299

(5) Japanese Utility Model Laid-Open Publication No. 2-117547

(6) Japanese Utility Model Laid-Open Publication No. 4-118499

(7) Japanese Utility Model Laid-Open Publication No. 4-118500

(8) Japanese Patent Laid-Open Publication No. 51-100728

(9) Japanese Patent Laid-Open Publication No. 57-125962

(10) Japanese Patent Laid-Open Publication No. 57-125963

(11) Japanese Patent Laid-Open Publication No. 59-2069

(12) Japanese Patent Laid-Open Publication No. 59-89372

(13) Japanese Patent Laid-Open Publication No. 59-93764

(14) Japanese Patent Laid-Open Publication No. 62-102270

(15) Japanese Patent Laid-Open Publication No. 64-101576

(16) Japanese Patent Laid-Open Publication No. 64-101577

(17) Japanese Patent Laid-Open Publication No. 3-249661

(18) Japanese Patent Laid-Open Publication No. 4-356085

(19) Japanese Patent Laid-Open Publication No. 4-356086

(20) Japanese Patent Laid-Open Publication No. 4-356087

(21) Japanese Patent Laid-Open Publication No. 4-356088

(22) Japanese Patent Laid-Open Publication No. 4-356089

(23) Japanese Patent Laid-Open Publication No. 4-91298

(24) Japanese Patent Laid-Open Publication No. 4-281096

(25) Japanese Patent Laid-Open Publication No. 57-114171

(26) Japanese Patent Laid-Open Publication No. 5-2356

(27) Japanese Patent Laid-Open Publication No. 5-127571

(28) Japanese Patent Laid-Open Publication No. 5-61382

(29) Japanese Utility Model Laid-Open Publication No. 63-140577

(30) Japanese Patent Laid-Open Publication No. 2-111987

(31) Japanese Patent Laid-Open Publication No. 1-137266

(32) Japanese Patent Laid-Open Publication No. 1-297294

(33) Japanese Patent Laid-Open Publication No. 4-333699

(34) Japanese Patent Laid-Open Publication No. 4-333088

(35) Japanese Patent Laid-Open Publication No. 4-64473

(36) U.S. Ser. No. 08/115,194 (filed Aug. 31, 1993)

(37) European Pat. Appln. No. 93113920 (filed Aug. 31, 1993)

SUMMARY OF THE INVENTION

It is an object of the present invention to provide an apparatus capable of removing an image forming substance from the surface of a sheet desirably, and a sheet processing apparatus.

It is another object of the present invention to provide an apparatus capable of removing an image forming substance from a sheet desirably by infiltrating the sheet with a liquid effectively, and a sheet processing apparatus.

It is another object of the present invention to provide an image forming substance removing apparatus capable of supplying a sheet with a desired amount of liquid, and a sheet processing apparatus.

It is another object of the present invention to provide an image forming substance removing apparatus capable of conveying a sheet supplied with a preselected processing liquid without causing it to crease, break or fold.

In accordance with the present invention, an apparatus for removing an image forming substance stably cohered to the surface of a sheet comprises a liquid supplying device for supplying a predetermined amount of a liquid to the sheet carrying the image forming substance, a conveying device for conveying the sheet supplied with the liquid along a transport path by nipping the sheet in the thicknesswise direction, and a removing device for removing the image forming substance from the sheet being conveyed by the conveying device.

Also, in accordance with the present invention, an apparatus for executing predetermined processing with a sheet by supplying a liquid to the sheet comprises a liquid supplying device movable while retaining the liquid on the surface thereof to thereby supply the liquid to the surface of the sheet, and a conveying device for conveying the sheet supplied with the liquid along a transport path by nipping the sheet in a thicknesswise direction of the sheet.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
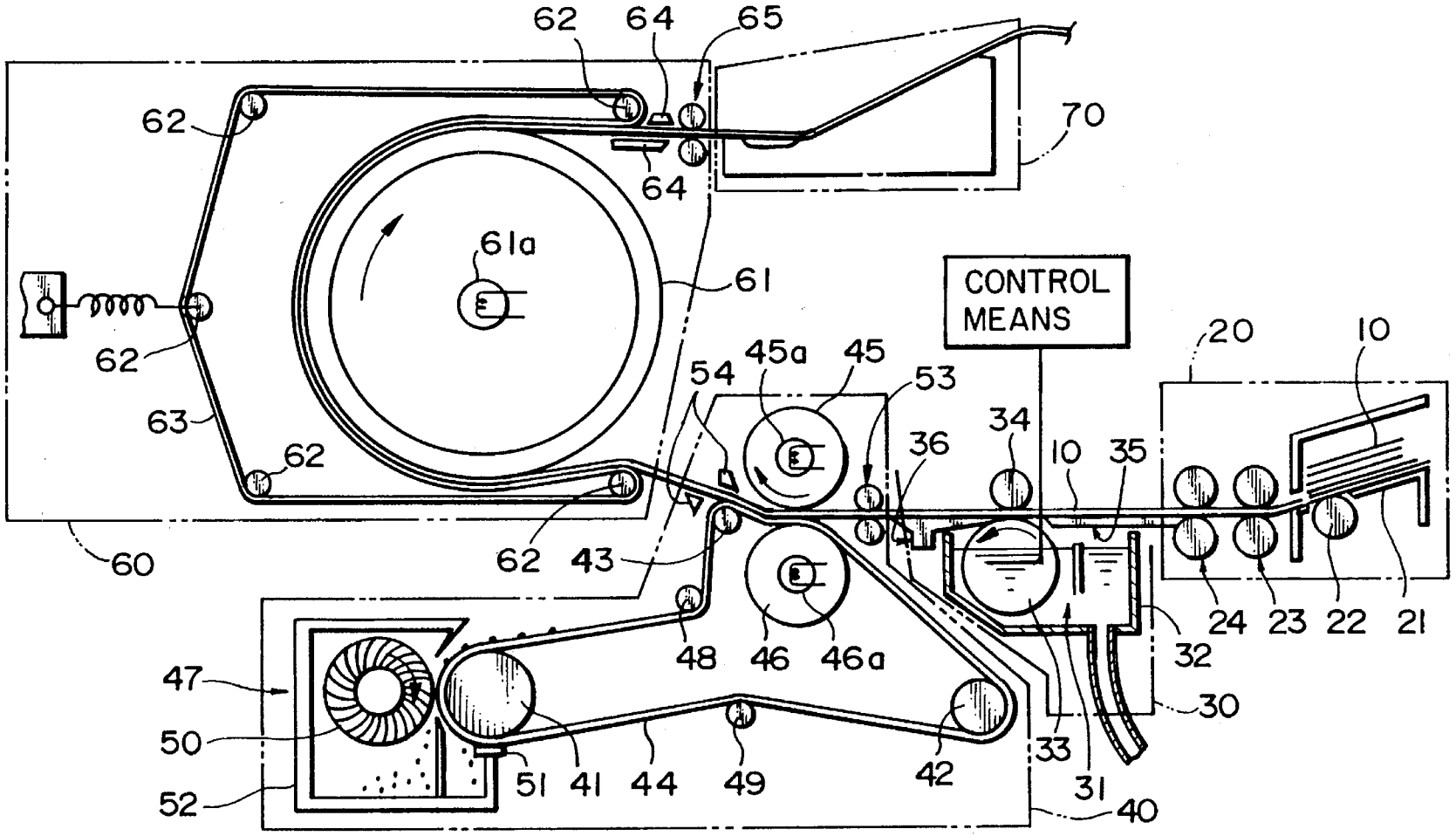
FIG. 1 is a section of a toner removing apparatus embodying the present invention.

Referring to FIG. 1 of the drawings, a preferred embodiment of the present invention is shown and implemented as an apparatus for removing a toner from copy sheets by way of example. As shown, the apparatus has a sheet feed unit 20 accommodating a stack of sheets 10 each carrying a toner image thereon. The sheets 10 are sequentially fed from the sheet feed unit 20 to a liquid supply unit 30. The liquid supply unit 30 supplies a liquid to the incoming sheet 10. A toner removing unit 40 removes the toner from the sheet coming out of the liquid supply unit 30. A drying unit 60 dries the sheet 10 from which the toner has been removed. A sheet receiving unit 70 receives the sheet 10 driven out of the drying unit 60.

In the sheet feed unit 20, the sheets 10 are stacked on a table 21 face down, i.e., with their image-surfaces facing downward. A pick-up roller 22 drives the lowermost sheet 10 of the stack while a separation roller pair 23 separates it from the overlying sheets 10. As a result, only one of the sheets 10 is fed out by a feed roller pair 24. The specific construction and operation of the sheet feed unit 20 will not be described since they are identical with those of a sheet feed mechanism of a conventional electrophotographic copier.

The liquid supply unit 30 stores a liquid 31 and supplies it to the paper 10. The liquid 31 may be implemented by water or an aqueous solution containing a surface active agent. Specifically, the liquid 31 is stored in a vessel 32. An applicator roller 33 is partly immersed in the liquid 31 and rotatable to apply the liquid 31 to the image surface of the sheet 10. A regulator roller, or sheet restricting member, 34 faces the applicator roller 33 with the intermediary of a sheet transport path. For the applicator roller 33, use may be made of a roller made of a hydrophile porous material, sponge or similar material having a liquid-retaining capability, or a roller made of rubber or similar elastic material or metal or similar rigid material. The roller made of such an elastic or rigid material should preferably be formed with a plurality of axially extending grooves for drawing up the liquid 31. At the position where the applicator roller 33 faces the sheet 10, the liquid 31 is supplied from the former to the latter in an amount corresponding to, for example, more than 35%, preferably 40% to 120%, of the mass of the sheet 10. The applicator roller 33 is rotated at such a speed that it does not run out of the liquid 31 at the above-mentioned position despite the supply of such an amount of liquid 31 to the sheet 10. The regulator roller 34 is pressed against the applicator roller 33 or is spaced apart from the roller 33 by a gap smaller than the thickness of the sheet 10 increased due to the infiltration of the liquid 31, so that it can convey the sheet 10 in cooperation with the applicator roller 33. It is to be noted that the liquid 31 infiltrated into the sheet 10 increases the thickness of the sheet 10 even by about 50%, depending on the amount thereof. Alternatively, the gap between the rollers 34 and 33 may be selected to be greater than the thickness of the wet or swollen sheet 10. In any case, the regulator roller 34 is rotated clockwise.

Figure 2A:
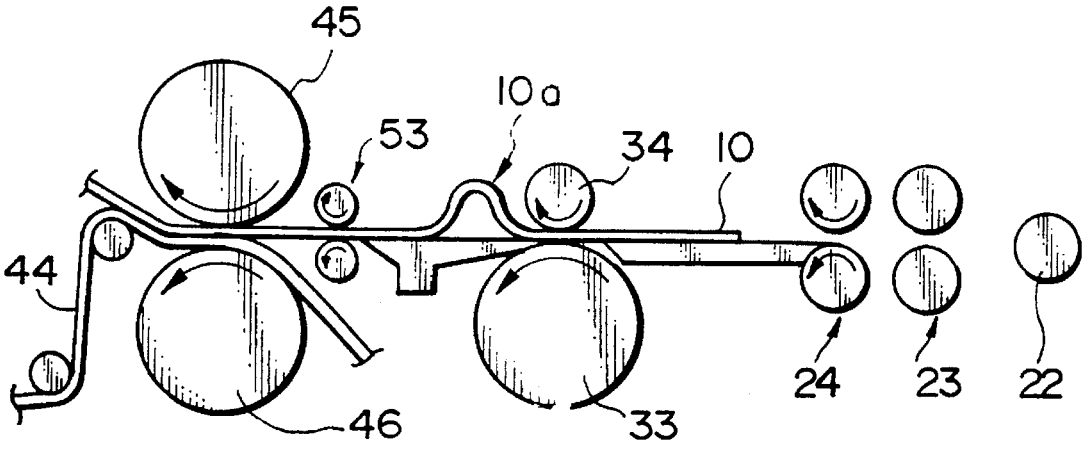
FIGS. 2A and 2B each shows a particular condition of sheet transport.
Figure 2B:
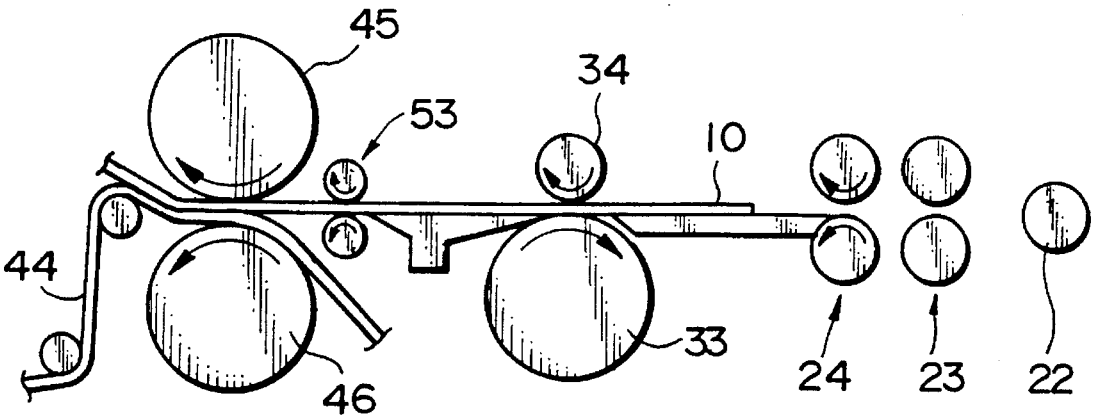

The applicator roller 33 is rotated counterclockwise when it and the regulator roller 34 convey the sheet 10 by nipping it therebetween. On the other hand, when the gap between the rollers 33 and 34 is greater than the thickness of the swollen sheet 10, the roller 33 may, basically, be rotated either clockwise or counterclockwise. However, when the gap is greater than the thickness of the swollen sheet 10, the applicator roller 33 should preferably be rotated counterclockwise, as illustrated, at least until the leading edge of the sheet 10 has been caught by a conveyor roller pair 53 which will be described later. This will enhance the stable transport of the sheet 10. Also, in such a gap condition, the applicator roller 33 may be rotated at a linear velocity higher than the sheet transport speed in order to prevent it from running out of the liquid 31 at the gap. This, however, brings about a problem that, as shown in FIG. 2A, the trailing edge of the sheet 10 is driven at high speed via the liquid film to, in turn, cause the sheet 10 to form a bend 10*a*, resulting in a jam or similar fault. FIG. 2B shows an implementation for eliminating this problem. As shown, at least after the trailing edge of the sheet 10 has moved away from the nip portion of the feed roller pair 24, the applicable roller 33 should preferably be rotated clockwise such that the surface thereof moves in the direction opposite to the sheet transport direction. Specifically, under the control of the control means the applicator roller 33 may be rotated counterclockwise, as shown in FIG. 1, until the leading edge of the sheet 10 has been caught by the conveyor roller pair 53, and then rotated clockwise before the trailing edge of the sheet 10 moves away from the nip portion of the feed roller pair 24.

Figure 3A:
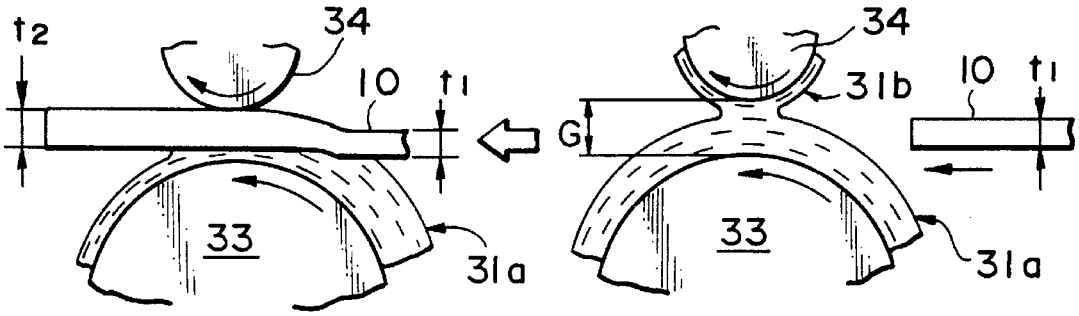
FIGS. 3A–3C each shows a film formed on an applicator roller and having a particular thickness.
Figure 3B:
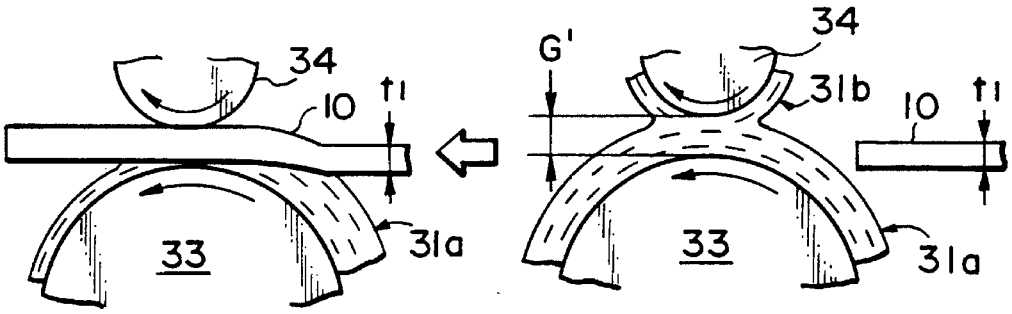
Figure 3C:
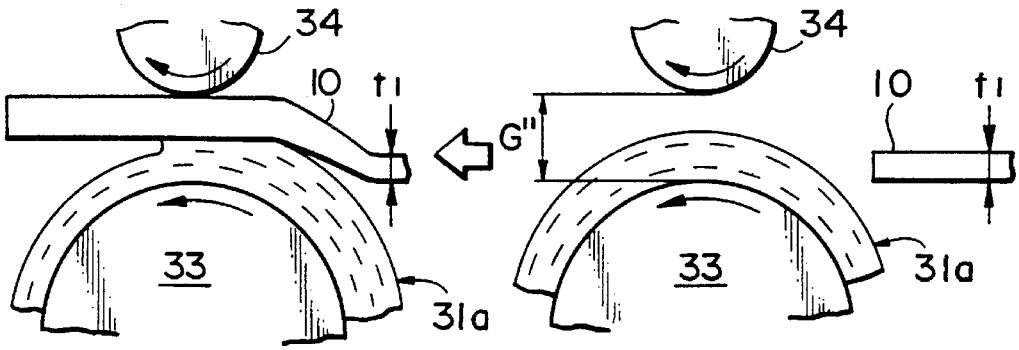

FIGS. 3A, 3B and 3C demonstrate the results of a series of studies and experiments conducted to determine a relation between the gap between the rollers 33 and 34 and the amount of liquid supply. As shown in FIG. 3A, it was found desirable to provide a gap G between the rollers 33 and 34 which is greater than the thickness $t_2$ of the sheet sucked up the desired amount of liquid, and to so rotate the roller 33 as to supply the liquid in an amount which fills up or substantially fills up the gap G. Specifically, assume that the sheet is of A4 size and has a thickness $t_1$ of 90 μm and a mass of 4 g when dry. Then, as about 4 g of liquid, which is a desired amount, is supplied to the sheet, the thickness of the sheet increased to about 135 μm. While the gap G between the rollers 33 and 34 was sequentially changed, the weights of such sheets moved away from the gap G and sucked up the liquid were measured. The measurement showed that the desired amount of liquid can be supplied to the sheet when the gap G ranges from more than 150 μm to less than 300 μm. For the measurement, the applicator roller 33 was rotated at a peripheral speed higher than the sheet transport speed and which prevented the liquid from becoming short in the gap G despite the transfer of the desired amount of liquid from the roller 33 to the sheet. FIG. 3A shows, at the right-hand side, a condition before the entry of the sheet 10 into the gap G and particular to a case wherein the gap G, lying in the above-mentioned desirable range, was comparatively small. As shown, a liquid film 31*a* on the applicator roller 33 contacted the regulator roller 34 and formed a relatively thin layer on the roller 34. When the gap G, lying in the desirable range, was comparatively great, the film 31 on the roller 33 appeared as if it contacted the roller 34.

On the other hand, as shown in FIG. 3B, when a gap G' smaller than 130 μm, which is the thickness of the sheet sucked up the desired amount of liquid, was provided between the rollers 33 and 34, the amount of liquid supply to the sheet was short. Further, as shown in FIG. 3C, when a gap G" greater than about 300 μm, which obviously separates the film 31*a* on the roller 33 and the roller 34, was provided, the amount of liquid supply to the sheet was also short. In the case of FIG. 3B, the gap G' is, presumably, too small and limits the increase in the thickness of the sheet 10 despite the infiltration of the liquid. In the case of FIG. 3C, the gap is, presumably, too great and simply causes the sheet 10 to rest on the film 31*a*, preventing the liquid from sufficiently infiltrating into the upper surface of the sheet 10.

Figure 4:
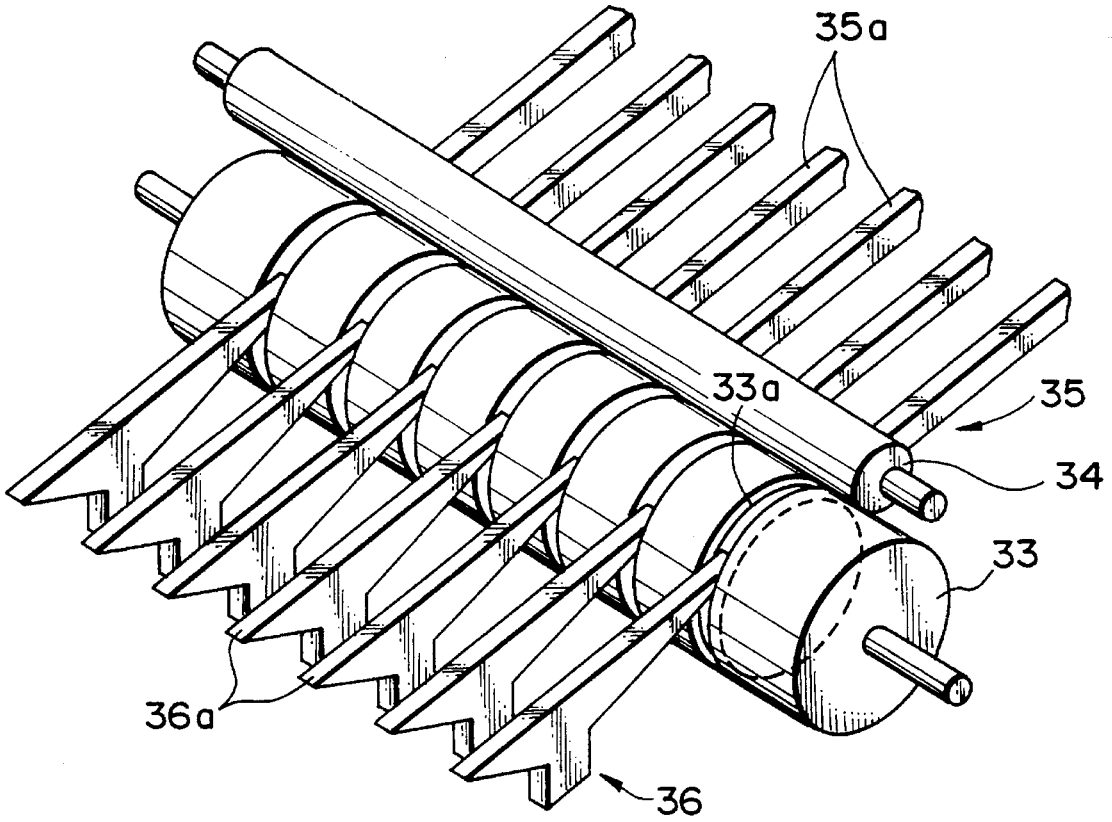
FIG. 4 is a perspective view showing a specific configuration of a sheet guide mechanism.

Referring again to FIG. 1, the liquid supply unit 30 includes a first and a second sheet guide mechanism 35 and 36, respectively. The first sheet guide mechanism 35 guide the sheet 10 coming out of the sheet feed unit 20 to between the applicator roller 33 and the regulator roller 34 (referred to as a liquid supply position hereinafter). The second guide mechanism 36 guides the sheet 10 coming out of the liquid supply position to the toner removing unit 40. As shown in FIG. 4 specifically, the guide mechanisms 35 and 36 may each comprise a plurality of thin guide elements 35*a* or 36*a* arranged in the widthwise direction of the sheet 1 and so positioned as to guide the sheet 10 with their upper edges. In addition, to insure the sheet guide, a guide mechanism implemented by wires may be located above the sheet transport path in such a manner as to guide or restrict the upper surface of the sheet 10. In the specific configuration of FIG. 4, a plurality of annular grooves 33*a* are formed in the periphery of the applicator roller 33 while the tip portions of the guide elements 36*a* are received in the grooves 33*a*. This surely guides the wet and softened sheet 10 to the toner removing unit 40.

As shown in FIG. 1, the toner removing unit 40 has a belt, or offset belt as often referred to hereinafter, 44 passed over a plurality of support rollers 41, 42 and 43. An upper and a lower heat roller 45 and 46, respectively, are pressed against each other with the intermediary of the offset belt 44. Heat lamps 45*a* and 46*a* are disposed in the heat rollers 45 and 46, respectively. A belt cleaner 47 removes the toner from the surface of the belt 44. The belt 44 has at least the front thereof made of a substance which is easy for the softened toner to adhere. For example, the entire belt 44 may be made of aluminum, copper, nickel or similar metal or a polymer, e.g., polyethylene terephthalate (PET) in which titanium oxide is dispersed. When the surface of the belt 44 is implemented by a polymer, it should preferably have two or more layers, i.e., at least a base and a surface layer so as to be free from slackening due to tension and heat and be durable.

The portion of the offset belt 44 moved away from the heat rollers 45 and 46 wraps around, among the rollers 41–43, the roller 43 having a smaller diameter than the others. A guide roller 48 presses inward the portion of the belt 44 between the roller 43 and the roller 41 which faces the belt cleaner 47. In this configuration, the the belt 44 is sharply steered by the roller 43 in order to separate the sheet 10 from the belt 44 on the basis of curvature. The roller 42, around which the portion of the belt 44 advancing to between the heat rollers 45 and 46 wraps, is implemented as a crown roller in order to prevent the belt 44 from being displaced. Further, a tension roller 49 presses inward the portion of the belt 44 between the roller 42 and the belt cleaner 47.

The heat rollers 45 and 46 press the image surface of the sheet 10 against the offset belt 44 and, at the same time, removes the toner from the sheet 10 by softening it by heat. Preferably, the degree of heating should not exceed one which would cause the toner on the sheet 10 to melt at the position where the upper heat roller 45 is pressed against the belt 44. If the toner melts, it will be difficult to transfer the entire toner from the sheet 10 to the belt 44. The upper heat roller 45 heats the toner on the sheet 10 to a temperature close to the softening point of the sheet 10. However, if the heat roller 45 heats the sheet 10 excessively, the sheet 10 passing through between the heat roller 45 and the belt 44 is dried to an excessive degree. As a result, when the leading edge of the sheet 10 separated by the curvature around the roller 43 again contacts the surface of the belt 44 due to gravity or similar cause, the toner once transferred to the belt 44 is apt to return to the sheet 10. Moreover, it is likely that the adhesion of the toner to the sheet 10 becomes more intense when the sheet 10 is excessively dried than when it is wet. Preferably, therefore, the degree of heating should be such that the sheet 10 moved away from the heat rollers 45 and 46 still contains some moisture to prevent the toner transferred to the belt 44 from again depositing on the sheet 10. Specifically, assuming a sheet of A4 size and having a mass of 4 g, the moisture content should preferably be about 0.5 g to 2.5 g (12% to 63%). For example, the lamp 45*a* of the upper heat roller 45 is controlled such that the surface temperature of the roller 45 remains at a preselected temperature lying in the range of from 80° C. to 115° C.

The lower heat roller 46 cooperates with the upper heat roller 45 to soften the toner deposited on the sheet 10. Again, the heat roller 46 should not dry the sheet 10 excessively. For this purpose, the lamp 46*a* of the heat roller 46 may be so controlled as to maintain the surface of the roller 46 at a preselected temperature lying in the range of 70° C. to 115° C.

We found that to promote easy transfer of the toner to the offset belt 44 and to minimize the damage to the fibers of the sheet 10, part of the toner contacting the sheet 10 should be more softened than part of the same contacting the belt 44, i.e., the surface portion. In light of this, the temperatures of the lamps 45*a* and 46*a* should preferably be controlled such that the surface temperature of the belt 44 directly contacting the toner is lower than that of the upper heat roller 45 heating the toner via the paper 10. In this connection, assume that the belt 44 is made of metal and as thin as about 0.1 mm and can be regarded to be the same in temperature as the surface of the lower heat roller 46, as measured at the nip portion of the rollers 45 and 46. Then, the lamp 46*a* may be controlled by sensing the surface temperature of the heat roller 46 and comparing it with the desired surface temperature of the belt 44. Even when the above assumption does not hold, the differences between the surface temperature of the heat roller 46 and that of the belt 44, as measured at the nip portion of the rollers 45 and 46, may be determined by experiments and taken into account in controlling the lamp 46*a* based on the sensed surface temperature of the roller 46.

The belt cleaner 47 has a rotatable brush roller 50 which removes the toner from the offset belt 44 by exerting a scratching force thereon intermittently. A pad 51 is positioned downstream of the brush roller 50 with respect to the moving direction of the belt 44. The pad 51 is held in contact with the belt 44 and scrabs it to remove the toner. The toner removed by the brush roller 51 and pad 51 is collected in a casing 52. The brush roller 50 may advantageously be implemented by a brass brush or a resin brush (e.g. nylon brush) containing grinding particles. For example, when brass filaments having a diameter of 0.15 mm were implanted in a roller having a diameter of 55 mm and the roller was rotated at a speed higher than 1000 rpm, the roller sufficiently removed the toner from the belt 44. The brush roller 50 implemented by such an elastic material is particularly desirable when the surface of the belt 44 is made of resin which is lower in hardness than metal. When the surface of the belt 44 is formed of metal or similar hard material, the brush roller 50 may be replaced with a rigid blade.

Regarding the removal of the toner from the belt 44, it should preferably be effected after the toner softened by heat has been cooled to a certain degree. Should the toner be further softened and become excessively viscous due to, for example, heat attributable to the mechanical friction of the brush roller 50, it would cohere to the brush and other cleaning members and degrade their cleaning ability. For this reason, the part of the belt 44 moved away from the heat rollers 45 and 46 should preferably have been cooled at least to a temperature lower than the softening point of the toner, e.g., to lower than 70° C. when it arrives as the cleaning section. The embodiment, therefore, locates the cleaning section at a position sufficiently remote from the heat rollers 45 and 46. If desired, cooling means using air or water may be additionally used to cool off the belt 44 before and/or when the belt 44 reaches the cleaning section. For example, a fan may be used to generate a stream of air in the casing 52 in the axial direction of the brush roller 50. Such a stream of air will not only cool the belt 44 via the opening of the casing 52 but also cool the brush roller 50. As a result, the toner adhered to the brush roller 50 will be solidified and then removed on hitting against the belt 44 or a flicker member, not shown.

In the toner removing unit 40, the previously mentioned conveyor roller pair 53 plays the role of conveying means for driving the sheet 10 coming out of the liquid supply unit 30 into the pressing section where the heat rollers 45 and 46 are located. The conveyor roller pair 53 may be constructed to squeeze out part of the liquid 31 infiltrated into or deposited on the sheet 10. Also disposed in the toner removing unit 40 are an upper and a lower guide member 54 for guiding the sheet 10, moved away from the pressing section and separated from the offset belt 44 by the roller 43, toward the drying unit 60.

Figure 5A:
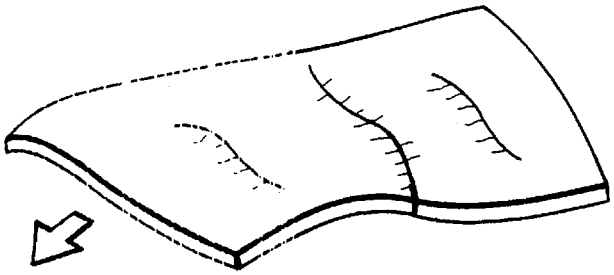
FIGS. 5A and 5B demonstrate how a sheet in transport is caused to crease.
Figure 5B:
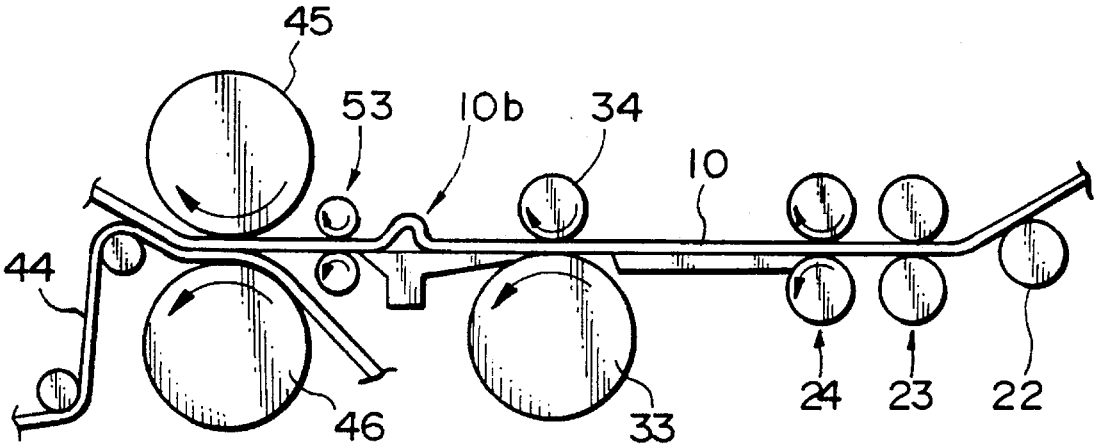

Experiments showed that when the feed roller pair 24, conveyor roller pair 53, upper heat roller 45 and offset belt 44, constituting a paper transport system in combination, are driven at the same linear velocity, the sheet 10 creases in substantially the widthwise direction thereof, as shown in FIG. 5A. By extended studies, we found the causes of such creases, as follows. As shown in FIG. 5B, the sheet 10 advancing into the conveyor roller pair 53 forms a bend 10*b*, and the bend 10*b* is directly passed through the roller pair 53 to result in a crease. Moreover, the bend 10*b* is derived from the fact that the sheet 10 extends by, for example, about 3% in the direction of transport due to the liquid supplied by the applicator roller 33. Specifically, as shown in FIG. 5B, when the sheet 10 is nipped by both the feed roller pair 24 and the conveyor roller pair 53, the sheet 10 downstream of the applicator roller 33 moves at an apparent speed which is the sum of the conveying speed of the feed roller pair 24 and the lengthwise extension of itself attributable to the liquid 31. The transport by the conveyor roller 53 cannot follow such a movement of the sheet 10, causing the sheet 10 to slacken. This slack results in the crease since the sheet 10 has been softened by the liquid 31.

Figure 6A:
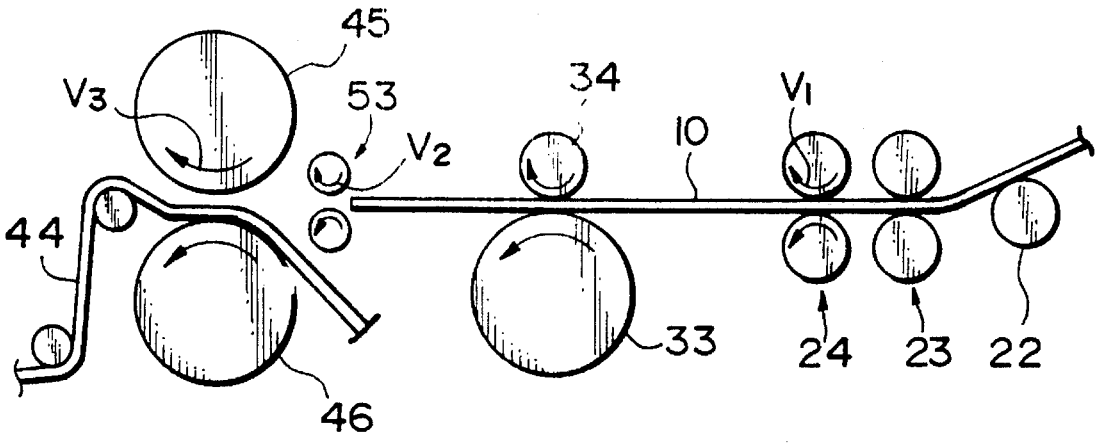
FIGS. 6A and 6B are views for describing the sheet transport speeds of conveyor roller pairs.
Figure 6B:
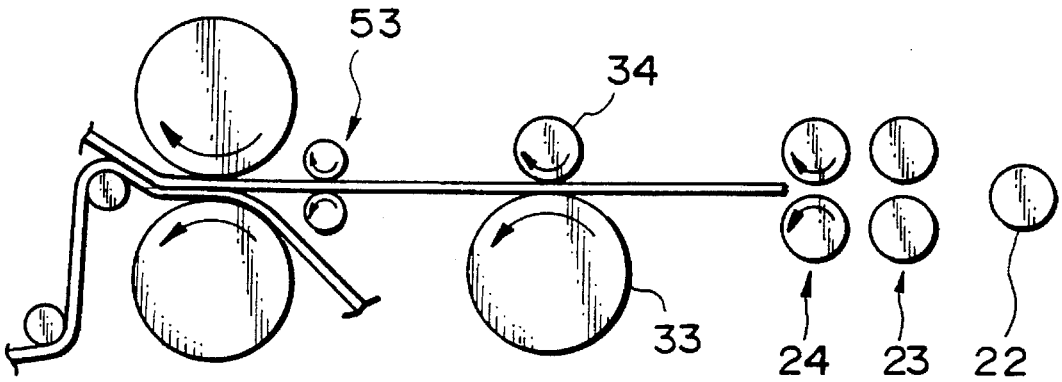

The embodiment obviates the widthwise creases with the following implementation. FIG. 6A shows a condition wherein the leading edge of the sheet 10 being driven by the feed roller pair 24 is caught by the conveyor roller pair 53 of the toner removing unit 40. FIG. 6B shows a condition wherein the trailing edge of the sheet 10 has moved away from the feed roller pair 24. In the illustrative embodiment, at least during the interval between the conditions shown in FIGS. 6A and 6B, the conveyor roller pair 53 is driven at a linear velocity $V_2$ higher than the linear velocity $V_1$ of the feed roller pair 24. Specifically, the linear velocity $V_2$ is selected to be higher than the linear velocity $V_1$ at least by a velocity corresponding to the extension of the sheet 10 (e.g. 3% as mentioned above) due to the liquid 31. Preferably, the linear velocity $V_2$ should be further higher than the linear velocity $V_1$ such that the conveyor roller pair 53 slightly pulls the sheet 10 while conveying it. However, the difference between the linear velocities $V_2$ and $V_1$ has to be determined in consideration of the limit of extendability of the sheet 10 due to the pulling force; otherwise, the sheet 10 would be broken. For example, assuming that the linear velocity of the feed roller pair 53 is 49.5 mm/sec, the conveyor roller pair 53 is driven at more than about 1.5 mm/sec higher linear velocity. To obviate the widthwise creases of the sheet 10, it is also preferable that the upper heat roller 45 and offset belt 44 contacting each other be moved at a linear velocity $V_3$ slightly higher than the linear velocity $V_2$ of the conveyor roller pair 53. This will also cause the roller 45 and belt 44 to slightly pull the sheet 10 while driving it.

The drying unit 60 dries the sheet 10 such that the liquid remains in the sheet 10 in an amount which is less than 10% of the mass of the sheet 10. The drying unit 60 has a heat drum 61 made of, for example, aluminum and accommodating a heat lamp 61*a* therein. A belt 63 is passed over a plurality of support rollers 62 while wrapping around the heat drum 61 over a predetermined angle. In the illustrative embodiment, one of the support rollers 62 plays the role of a tension roller at the same time. The heat drum 61 should preferably have a diameter great enough to prevent the sheet 10 from curling easily, e.g., greater than about 90 mm.

The belt 63, used to press the sheet 10, may be made of a heat-resistive and air-permeable material, e.g., canvas, cotton or Tetron. Preferably, the material of the belt 63 should be sparingly stretchable. The outer periphery of the heat drum 61 and the inner periphery of the belt 63 nip the sheet 10 therebetween with a certain degree of force. For example, assuming that the belt 63 is 240 mm wide, the belt tension should preferably be higher than 7 kg, preferably higher than 15 kg. Such a condition allows the sheet 10 to contract in an entirely free state without creasing and to prevent it from curling or waving easily. To reduce the liquid of the sheet 10 to less than 10% of the mass of the sheet 10, it is preferable that the lamp 61*a* be so controlled as to maintain the surface temperature of the heat drum 61 higher than 100° C.

Figure 7A:
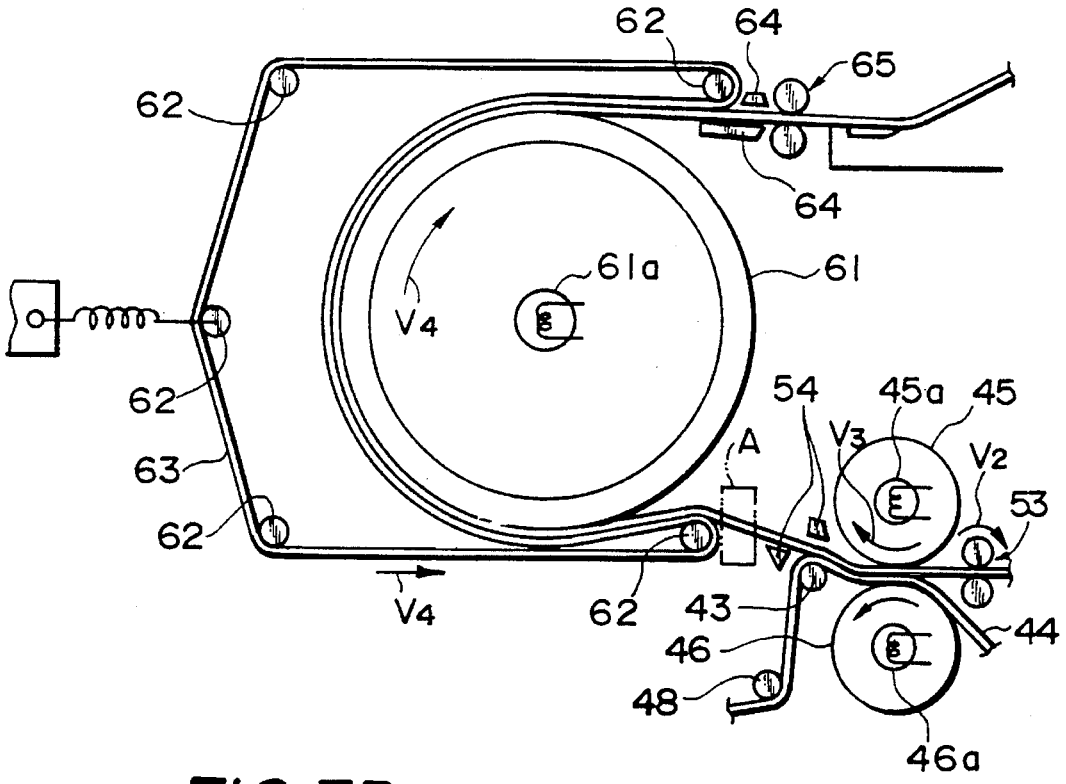
FIGS. 7A–7C are views for describing the sheet transport speeds of a drying unit.
Figure 7B:
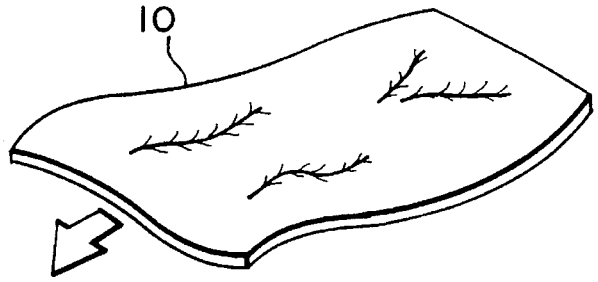
Figure 7C:
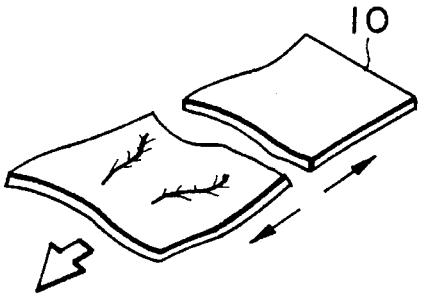

As shown in FIG. 7A, the paper transport speed in the drying unit 60, e.g., the linear velocity $V_4$ of the heat drum 61 and belt 63 should preferably be lower than the linear velocity $V_3$ of the upper heat roller 45 and offset belt 44, which is located upstream of the unit 60 in the sheet transport direction. This is to prevent the sheet 10 from creasing in substantially the sheet transport direction, as shown in FIG. 7B, and to prevent it from being torn off due to the low tensile strength thereof, as shown in FIG. 7C. This kind of creases and breakage occur since the sheet 1 contracts due to drying in the region where the heat drum 61 and belt 63 contact each other. Specifically, when the sheet 10 contracts in the above-mentioned region, part of the sheet 1 close to the trailing edge moves toward part of the sheet 1 adjoining the leading edge and dried more than the former. As a result, the trailing edge portion is, apparently, pulled at a velocity higher than the linear velocity of the drum 61 and belt 63. Hence, should the linear velocity V4 of the drum 61 and belt 63 be the same as the linear velocity V3 of the heat roller 45 and offset belt 44, an excessive degree of tension would act on the trailing edge portion nipped by the roller 45 and belt 44, resulting in the creases or breakage.

Figure 8A:
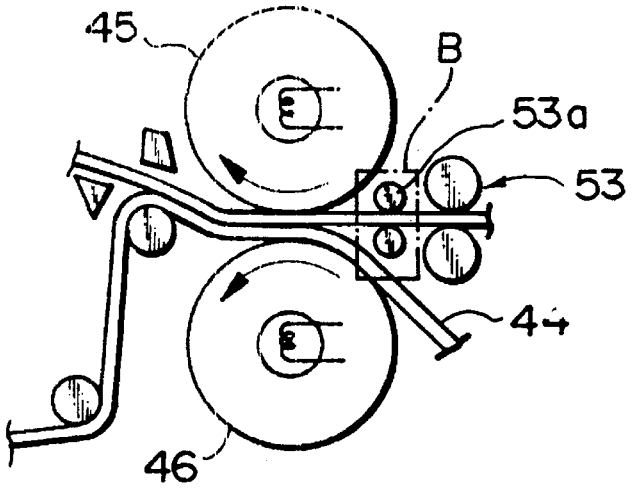
FIGS. 8A and 8B show a specific configuration of conveying means capable of preventing a sheet from creasing.
Figure 8B:
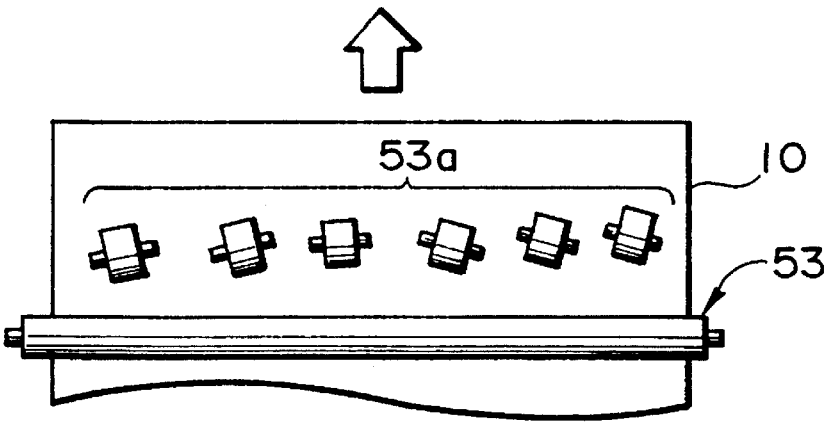

FIGS. 8A and 8B show conveying means which may be used to convey the sheet 10 while spreading it toward opposite edges in the widthwise direction. The conveying means may be located just before the position where the upper heat roller 45 is pressed against the offset belt 40 (position B, FIG. 8A) and/or just before the position where the heat drum 61 is pressed against the belt 63 (position A, FIG. 7A). As shown in FIG. 8B specifically, the conveying means may be comprised of a plurality of rollers 53*a* each being slightly inclined toward the adjoining widthwise edge of the sheet 10. Alternatively, the conveying means may be implemented as, for example, a hand drum-like roller pair which is customary with the fixing unit of an image transfer type electrophotographic copier or similar equipment and heats and presses a sheet while pulling it in opposite directions. Such conveying means prevents the sheet 10 from creasing in the longitudinal direction due to the deformation of the sheet 10, as shown in FIG. 7B.

Figure 9A:
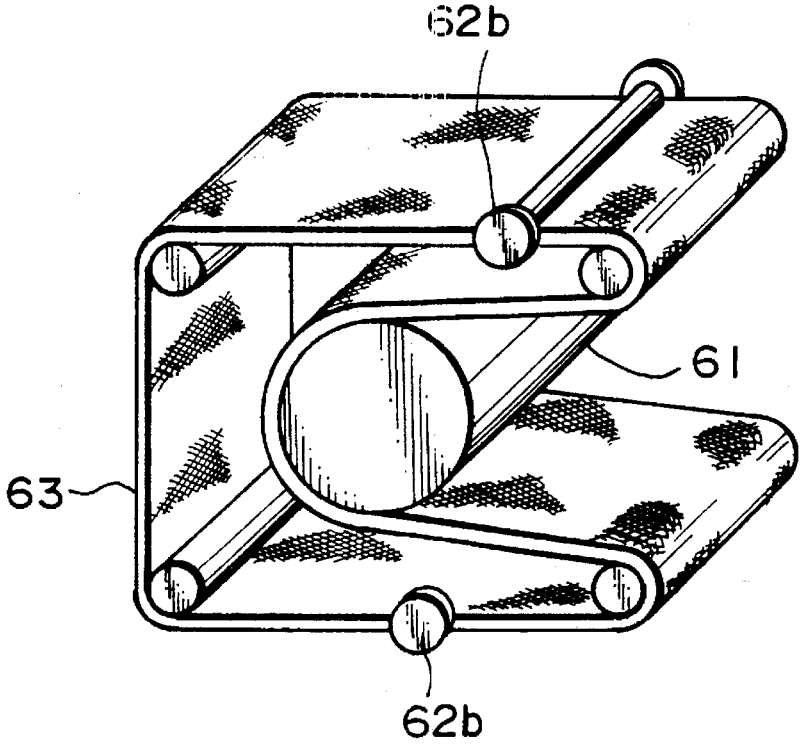
FIG. 9A PRIOR ART
FIGS. 9A and 9B show conventional rings used to prevent a belt from being displaced sideways.
Figure 9B:
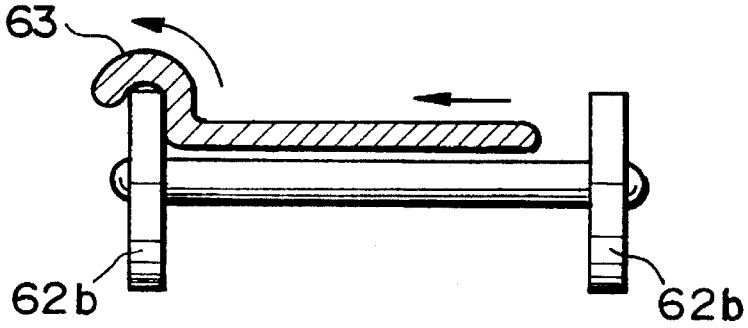
FIG. 9B PRIOR ART

To promote rapid drying in the drying unit 60, the belt 63 should preferably be thin and air-permeable. For example, it is preferable that the belt 63 be less than 1 mm thick when implemented by a cotton fabric or less than 0.5 mm thick when implemented by a fabric of chemical fibers, e.g., polyester or Tetron. However, such a thin belt 63 is easy to deform and cannot be fully prevented from being displaced sideways by conventional rubber support rollers, crown support rollers, rings or similar conventional implementation, as proved by experiments. For example, even when rings 62*b*, FIG. 9A, are used, the belt 63 deforms and gets over the rings, as shown in FIG. 9B taking the lower ring 62*b* as an example.

Figure 10A:
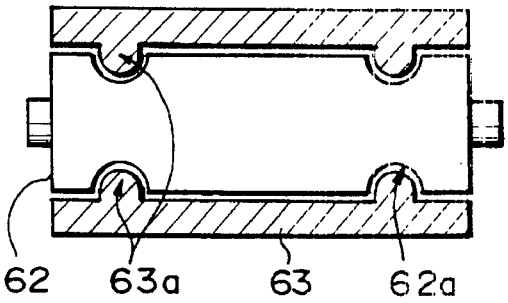
FIGS. 10A–10E show a mechanism for preventing a belt from being displaced sideways particular to the illustrative embodiment.
Figure 10B:
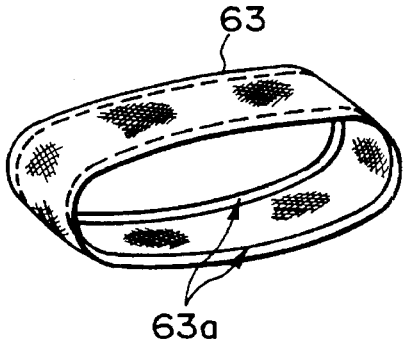
Figure 10C:
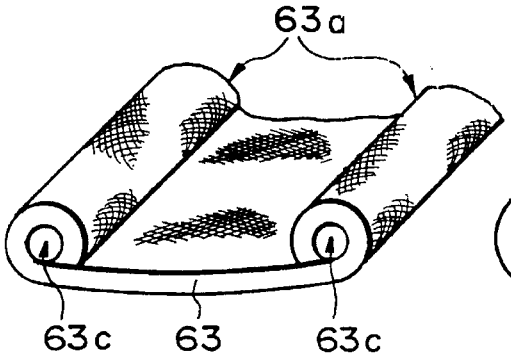
Figure 10D:
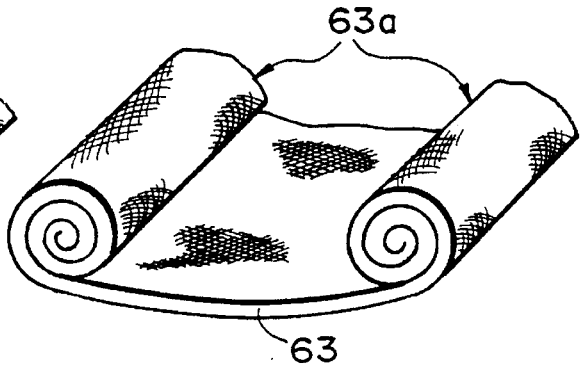
Figure 10E:
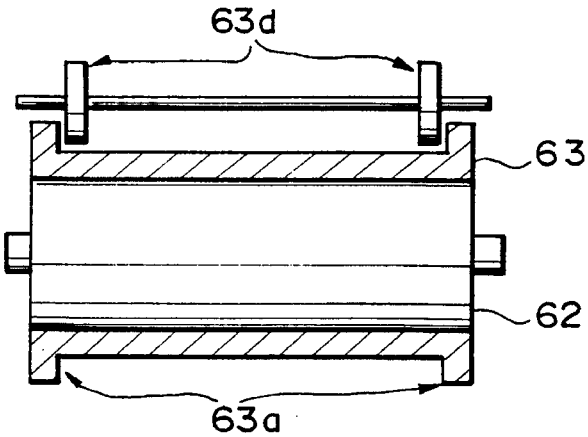

FIG. 10B shows a specific configuration of the belt 63 which was found to successfully prevent the belt 63 from being displaced sideways. As shown, annular ridges 63*a* are formed at opposite side edges on the inner periphery of the belt 63, and each has a certain degree of strength. The support rollers 62 are each formed with circumferential grooves 62*a* which can receive the annular ridges 63*a* of the belt 63. As shown in FIG. 10A, when the ridges 63*a* are brought into the grooves 62*a* while the belt 63 is in rotation, the position of the belt 63 is restricted in the axial direction of the roller 62, so that the entire belt 62 is prevented from being displaced sideways. As shown in FIGS. 10B and 10C, to form the annular ridges 63*a*, cores 63*c* made of rubber or implemented by wires may be wrapped and fixed by opposite side edges of the belt 63. Alternatively, as shown in FIG. 10D, the opposite side edges of the belt 63 may be simply rolled to have a certain degree of strength. Further, elongate members having a certain degree of strength may be adhered to or sewn on opposite side edges of the belt 63 in an annular configuration. In place of or in addition to the ridges 63*a* on the inner periphery of the belt 63, annular ridges may be formed on the outer periphery of the belt 63, in which case circumferential grooves matching them will be formed in the periphery of associated guide rollers. Furthermore, as shown in FIG. 10E, rings 63*d* may be provided for preventing the belt 63 from being displaced by abutting against the ridges 63*a* on the outer periphery of the belt 63. If desired, the ridges 63*a* may be formed not only at the opposite side edges but also at the other portions of the belt 63.

In the drying unit 60, an upper and a lower guide member 64 guide the sheet 10 coming out of the nip portion of the heat drum 61 and belt 63. A discharge roller pair 65 drives the sheet 10 from the guide members 64 out of the unit 60 onto the sheet receiving unit, or tray, 70.

The illustrative embodiment further includes sensor means for determining whether or not sheets 10 are present on the table 21, sensor means responsive to the simultaneous feed of two or more sheets 10 from the sheet feed unit 20, sensor means responsive to the amount of liquid remaining in the vessel 32, means for replenishing the liquid to the vessel 32, sensor means responsive to sheet jams, control means for turning on and turning off the individual heat lamps, means responsive to the full state of the casing 52 of the belt cleaner 47, sensor means responsive to the defective separation of the sheet 10 from the offset belt 44, etc.

In operation, as the sheet 10 fed from the sheet feed unit 20 arrives at the liquid supply unit 30, the liquid 31 is uniformly applied to the image surface of the sheet 10. Then, the toner removing unit 40 heats and softens the toner deposited on the sheet 10 with the result that the toner is transferred to the surface of the offset belt 44. When the sheet 10 and offset belt 44 are separated around the smaller diameter roller 43, the toner deposited on the offset belt 44 is removed from the sheet 10. Subsequently, the sheet 10 is dried by the drying unit 61 and then driven out to the sheet receiving unit 70.

As stated above, the embodiment supplies the liquid 31 to the sheet 10 carrying a toner thereon, and removes the toner from the sheet 10 infiltrated with the liquid 31 at the interface between it and the toner. Hence, the toner can be removed without the fibers of the sheet 10 being damaged The sheet 10 is brought into contact with the offset belt 44 with the surface thereof wet. In addition, the sheet 10 is heated only to such a degree that it remains wet even when it is separated from the belt 44. Hence, even when the surface of the belt 44 is made of a substance to which the toner adheres, the entire sheet 10 contacts the surface of the belt 44 and is freed from defective separation. Moreover, the return of the toner from the belt 44 to the sheet 10 is eliminated, which would otherwise occur due to the recontact of part of the sheet 10 separated from the belt 44 with the belt 44.

The sheet 10 infiltrated with the liquid 31 is pressed thicknesswise by the upper heat roller 45 and offset belt 44 and the conveyor roller pair 53 just preceding them. Therefore, the liquid 31 desirably infiltrates into the interface between the sheet 10 and the toner. This removes the toner efficiently without damaging the fibers of the sheet 10 even when the liquid 10 does not contain or contains only a small amount of surface active agent. The sheet 10 is free from a curl due to the expansion of only one side of the sheet 10 since the liquid 31 is supplied from one side. Such advantages will be further enhanced if the conveyor roller pair 53 exerts a pressure high enough to squeeze out the liquid 31.

Since the offset member is implemented as a belt, the pressing position and the cleaning position can be sufficiently spaced from each other. As a result, the toner is sufficiently cooled off before reaching the cleaning position and, therefore, prevented from cohering to the cleaning member.

While the embodiment supplies the liquid 31 only from the image surface side of the sheet 10, the liquid 31 may be supplied from the other side of the sheet 10 or even from both sides. To supply the liquid 31 to the sheet from both sides, a press roller pair may be immersed in the liquid 31 and cause the sheet 10 to move therethrough.

In the drying unit 60, the heat drum 61 and belt 63 may be replaced with a heat roller pair each accommodating a heat lamp and pressed against each other. In this case, to suppress the curl of the sheet 10 to, for example, less than 3 mm, the lamps of the rollers should preferably be controlled to maintain the surfaces temperatures of the rollers substantially the same as each other.

When the toner image on the sheet 10 is a solid black image having a substantial area, it will obstruct the infiltration of the toner into the sheet 10 from the image surface. To eliminate this problem, use may be made of means for shaving off at least part of the toner before the liquid 31 is supplied to the sheet 10. The shaving means may be constructed in the same manner as the belt cleaner 47.

An alternative embodiment of the present invention will be described hereinafter. In the embodiment shown in FIG. 1, the sheet 10 softened by the liquid 31 is conveyed by the second guide mechanism 36 and conveyor roller pair 53 to the pressing position where the upper heat roller 45 and offset belt 44 are positioned. This kind of configuration needs devices for preventing such a softened sheet 10 from creasing, folding or jamming the path. Particularly, when the liquid 31 is supplied from only one side of the sheet 10, the amount of liquid retained by the sheet 10 is apt to noticeably differ from the front to the rear, resulting in a curl and, therefore, a fold. In the embodiment to be described, the sheet 10 is conveyed by a single member, whose surface is movable, at least from the liquid supply section to the heating section.

Figure 11:
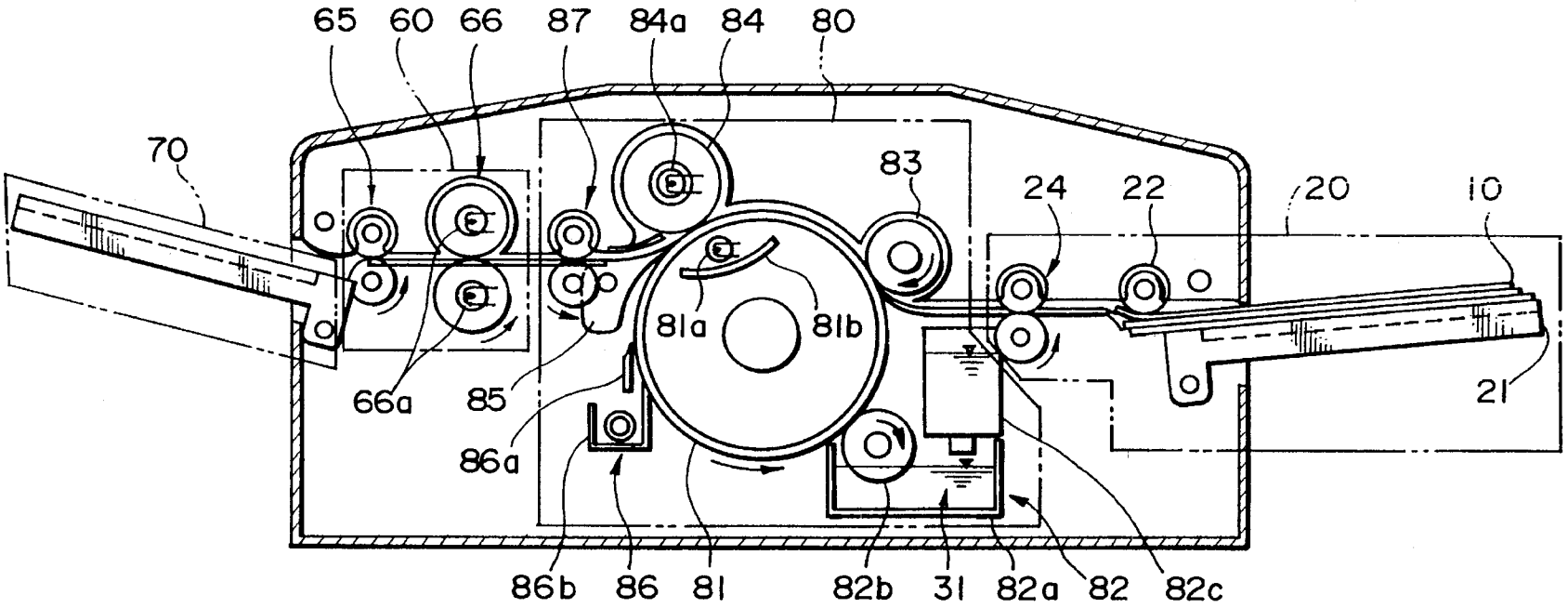
FIG. 11 is a section showing an alternative embodiment of the present invention.

As shown in FIG. 11, the alternative embodiment also includes the sheet feed unit 20 for sequentially feeding the sheets 10 stacked thereon. A liquid supply and toner removing unit 80 supplies the liquid 31 to the sheet 10 fed from the sheet feed unit 20 and then removes the toner from the sheet 10. The drying unit 60 dries the sheet 10 from which the toner has been removed. The sheet receiving unit 70 receives the sheet 10 coming out of the drying unit 60.

In the sheet feed unit 20, the sheets 10 are stacked on the table 21 face down and fed one by one by the automatic pick-up roller 22, the uppermost sheet 10 being first. Then, the sheet 10 is conveyed by the feed roller pair 24 out of the sheet feed unit 20. In this embodiment, a friction member, not shown, is fixed to a sheet guide surface, not shown, located below the pick-up roller 22. The friction member prevents two or more sheets 10 from being picked up at the same time. If desired, such a friction member may be replaced with the separation roller pair 23, FIG. 1.

The liquid supply and toner removing unit 80 has an offset drum 81 rotatable counterclockwise, as viewed in FIG. 11, and playing the role of a liquid supply member at the same time. A liquid supply device 82 supplies the liquid 31 to the offset drum 81. A roller 83 wraps the sheet 10 coming out of the sheet feed unit 20 around the drum 81 supplied with the liquid 31. A heat roller 84 heats the sheet 10 wrapped around the drum 81. A separator 85 separates the sheet 10 from the drum 81 after it has moved away from the position where the drum 81 faces the heat roller 84. A drum cleaner 86 removes the toner from the drum 81 from which the sheet 10 has been separated. A conveyor roller pair 87 conveys the sheet 10 separated from the drum 81 to the drying unit 60.

The offset drum 81, like the offset belt of FIG. 1, has a surface made of a substance which is easy for the toner to adhere. For example, the drum 81 may comprise a roller made of aluminum, copper, nickel or similar metal or a roller having a surface made of PET in which titanium oxide is dispersed or similar polymer. When use is made of a polymer, the surface of the drum 81 should preferably have two or more layers, i.e., at least a drum base and a surface layer from the strength standpoint.

The liquid supply device 82 supplies the liquid 31, e.g., an aqueous solution containing a surface active agent to the offset drum 81. The device 82, like the liquid supply unit 30 of FIG. 1, has a vessel **82*a* storing the liquid 31, and an applicator roller 82*b* partly immersed in the liquid 31 and rotatable for feeding the liquid 31 to the surface of the drum 81. A liquid tank 82*c* stores the liquid 31 to be replenished to the vessel 82*a*. Again, for the applicator roller 82*b*, use may be made of a roller made of a hydrophile porous material, sponge or similar material having a liquid-retaining capability, or a roller made of rubber or similar elastic material or metal or similar rigid material. The roller made of such an elastic or rigid material should preferably be formed with a plurality of axially extending grooves for drawing up the liquid 31. The roller 83 is rotated at a predetermined speed in or out of contact with the drum 81 such that the liquid 31 is supplied to the sheet 10, wrapping around the drum 81, in an amount corresponding to, for example, more than 35%, preferably 40% to 120%, of the mass of the sheet 10**.

The roller 83 may be urged against the offset drum 81 by biasing means, not shown, in order to wrap the sheet 10 around the drum 81. Alternatively, the roller 83 may be spaced apart from the drum 81 by a predetermined gap so long as the roller 83 can guide the sheet 10 in the wrapping fashion, preferably a gap smaller than the thickness of the sheet 10 infiltrated with the liquid 31. When the biasing means is used, the sheet 10 infiltrated with the liquid 31 is pressed thicknesswise on the drum 81 to promote the infiltration of the liquid 31 into the interface between the sheet 10 and the toner. In any case, the roller 83 may be rotated by the drum 81 either directly or by way of the sheet 10. Alternatively, at least until the leading edge of the sheet 10 has been stably wrapped around the drum 81, preferably until it has been caught by the heat roller 84 and drum 81, the roller 83 may be driven such that the surface thereof moves in the same direction and at substantially the same linear velocity as the drum 81.

Should the wet sheet 10 on the drum 81 extend in the longitudinal direction, bend, and reach the pressing position of the heat roller 84, it would be creased. This kind of crease can be obviated by the same arrangement as in the previous embodiment. Specifically, at the position where the heat roller 84 and drum 81 are pressed against each other, the roller 84, for example, may be driven at a higher linear velocity than the feed roller pair, or conveying means, 24 at least during a predetermined period of time. This successfully prevents the wet sheet 10 on the drum 81 from bending. However, the requisite with this embodiment is that the wet sheet 10 be prevented from bending as if it rose above the drum 81. It is, therefore, necessary to cause the part of the sheet 10, wrapping around the drum 81 from the position just before the heat roller 84 to the position of the roller 83, to extend while sliding on the drum 81 at least in an amount corresponding to a natural extension attributable to wetting. To meet this requirement, when the difference in linear velocity between such two conveying means is used to eliminate bending, the roller 83 is positioned such that the sheet 10 is displaceable between the roller 83 and the drum 81 to allow a tension attributable to the difference in linear velocity acts even on the above-mentioned part of the sheet 10. More specifically, the roller 83 is spaced apart from the drum 81 by a gap greater than the thickness of the sheet 10 having not been wet or is urged against the drum 81 by a relatively weak force. When the roller 83 is positively driven, it should preferably be driven at the same speed as the second conveyor roller pair 24.

The heat roller 84 accommodates a heat lamp **84*a* therein and is preferably pressed against the offset drum 81 by a predetermined force. The heat lamp 84*a* is controllably turned on such that it heats the toner on the sheet 10 to a temperature close to the softening point of the resin constituting the toner. However, when the lamp 84***a* heats the sheet 10 excessively, it is likely that the sheet 10 is dried to an excessive degree while passing through the pressing position. As a result, the adhesion of the toner to the sheet 10 becomes greater than when the sheet 10 is wet and causes the sheet 10 to cohere to the drum 81 via the toner; such a sheet 10 cannot be separated from the drum 81 by the separator 85, as discussed in relation to the previous embodiment. It is, therefore, preferable that the sheet 10 moved away from the heating position be still slightly wet, i.e., contains an amount of liquid 31 which prevents the toner from depositing again. For example, the lamp 84*a* is so controlled as to maintain the surface of the heat roller 84 at a preselected temperature lying in the range of from 80° C. to 115° C.

A separator moving mechanism is associated with the separator, or pawl, 85 and selectively moves it to a position where the edge adjoins the periphery of the offset drum 81 and the upper surface guides the sheet 10 to the conveyor roller pair 87, or to an inoperative or retracted position. To allow a minimum of toner to deposit on the edge of the separator 85, the mechanism moves the separator 85 to the retracted position as soon as the leading edge of the sheet 10 is caught by the conveyor roller pair 87.

The drum cleaner 86 has a cleaning blade 86*a* made of, for example, a highly rigid material, and a container 86*b* for collecting the toner removed from the offset drum 81 by the blade 86*a*. The cleaning blade, or shaving mechanism, 86*a* may be replaced with or combined with a rotatable brush roller or similar scratching mechanism and a pad or similar rubbing mechanism similar to those shown in FIG. 1.

A heat lamp 81*a* and a reflector 81*b* are also disposed in the offset drum 81 and located to face the heat roller 84. The heat lamp 81 and reflector 81*b* cooperate with the heat roller 84 to soften the toner deposited on the sheet 10. The lamp 81*a* is also controlled such that the surface of the drum 81 remains at a preselected temperature lying in, for example, the range of 70° C. to 115° C. and which prevents the sheet 10 from being excessively dried. The transfer of the toner from the sheet 10 to the drum 81 will be promoted if the softening degree is higher at the interface between the sheet 10 and the toner than at the surface portion of the toner which contacts the drum 81, as in the previous embodiment. Considering this, it is preferable that the surface temperature of the drum 81, directly contacting the toner, be lower than that of the heat roller 84 which heats the toner via the sheet 10.

When the heat roller 84 and the lamp 81*a* inside the offset drum 81 are not sufficient in heating the toner and sheet 10 alone, preheating means may be located at least at a drum portion moved away from the drum cleaning position, preferably a drum portion moved away from the liquid supply position, more preferably a drum portion moved away from the sheet wrapping position. Further, the liquid 31 inside the vessel 82*a* may be heated to heat the drum 81 and sheet 10 beforehand. In such a case, since the temperature of the liquid 31 is higher than room temperature, the effect that the fibers of the sheet 10 are protected from damage when the toner is removed from the sheet 10 by the drum 81 is enhanced. In this respect, the liquid 31 of the previous embodiment should preferably be heated, too.

The reflector 81*b* in the offset drum 81 causes the heat from the lamp 81*a* to concentrate on the portion of the drum 81 which faces the heat roller 84, thereby promoting efficient heating. In addition, the reflector 81*b* is used to cool the toner on the drum 81 to a certain degree before it reaches the cleaning position where the drum cleaner 86 is located, thereby facilitating the cleaning of the drum 81. Preferably, the surface temperature of the drum 81, as measured at the cleaning position, should be lower than at least the softening point of the toner, e.g., lower than 70° C. Moreover, should the toner be softened and made highly viscous by heat attributable to the mechanical friction of the cleaning blade and cleaning brush, it would cohere to the cleaning members easily. In light of this, cooling means using air or water may be located in the drum cleaner 86 or at a position where it can cool the portion of the drum 81 moved away from the heat roller 84, but not arrived at the cleaning position.

The drying unit 60 has a pair of finish rollers 66 rotatable in contact with each other and each accommodating a heat lamp 66*a*. The discharge roller pair 65 discharges the sheet 10 coming out of the finish roller pair 66 to the sheet receiving unit 70. The heat lamps 66*a* are controlled such that the surfaces of the associated rollers 66 remain at the same temperature in order to suppress the curl of the sheet 10 to, for example, less than 3 mm. In addition, the lamps 66*a* are controlled such that the sheet 10 finished by the roller pair 66 contains the liquid 31 in an amount less than 10% of the mass of the sheet 10.

Assume that the drying unit 60, like the drying unit 60 of FIG. 1, suffers from an occurrence that the sheet 10 contracts and, therefore, creases due to drying while passing through the finish roller pair 66. Then, it is preferable to rotate the finish roller pair 66 at a lower linear velocity than the conveyor roller pair 87 just preceding the finish roller pair 66. Conversely, assume that creases, for example, can be obviated more positively when the wet and softened sheet 10 is caught by the finish roller pair 66 while being slightly pulled. Then, it is preferable to drive the finish roller pair 66 at a slightly higher linear velocity than the conveyor roller pair 87.

Further, the conveying means shown in FIG. 8, which conveys the sheet 10 while spreading it in the widthwise direction, may be substituted for the conveyor roller pair 87 or located between the conveyor roller pair 87 and the finish roller pair 66.

In operation, when the sheet 10 is fed out from the sheet feed unit 20, the leading edge thereof abuts against the surface of the offset drum 81. Then, since the drum 81 is in rotation, the sheet 10 is sequentially wrapped around the drum 81 past the position where the roller 83 faces the drum 81. At this instant, the liquid 31 supplied to the drum 81 by the liquid supply device 82 infiltrates into the sheet 10. As a result, the sheet 10 infiltrated with the liquid 31 arrives at the position where the drum 81 faces the heat roller 84. At this position, the heat from the roller 84 and the heat from the lamp 81*a* of the drum 81 soften the toner on the sheet 10 and causes it to deposit on the drum 81. When the separator 85 separates the sheet 10 from the drum 81, the toner adhered to the drum 81 comes off the sheet 10. Finally, the sheet 10 is dried by the drying unit 60 and driven out to the sheet receiving unit 70.

Figures 12, 12A, 12B:
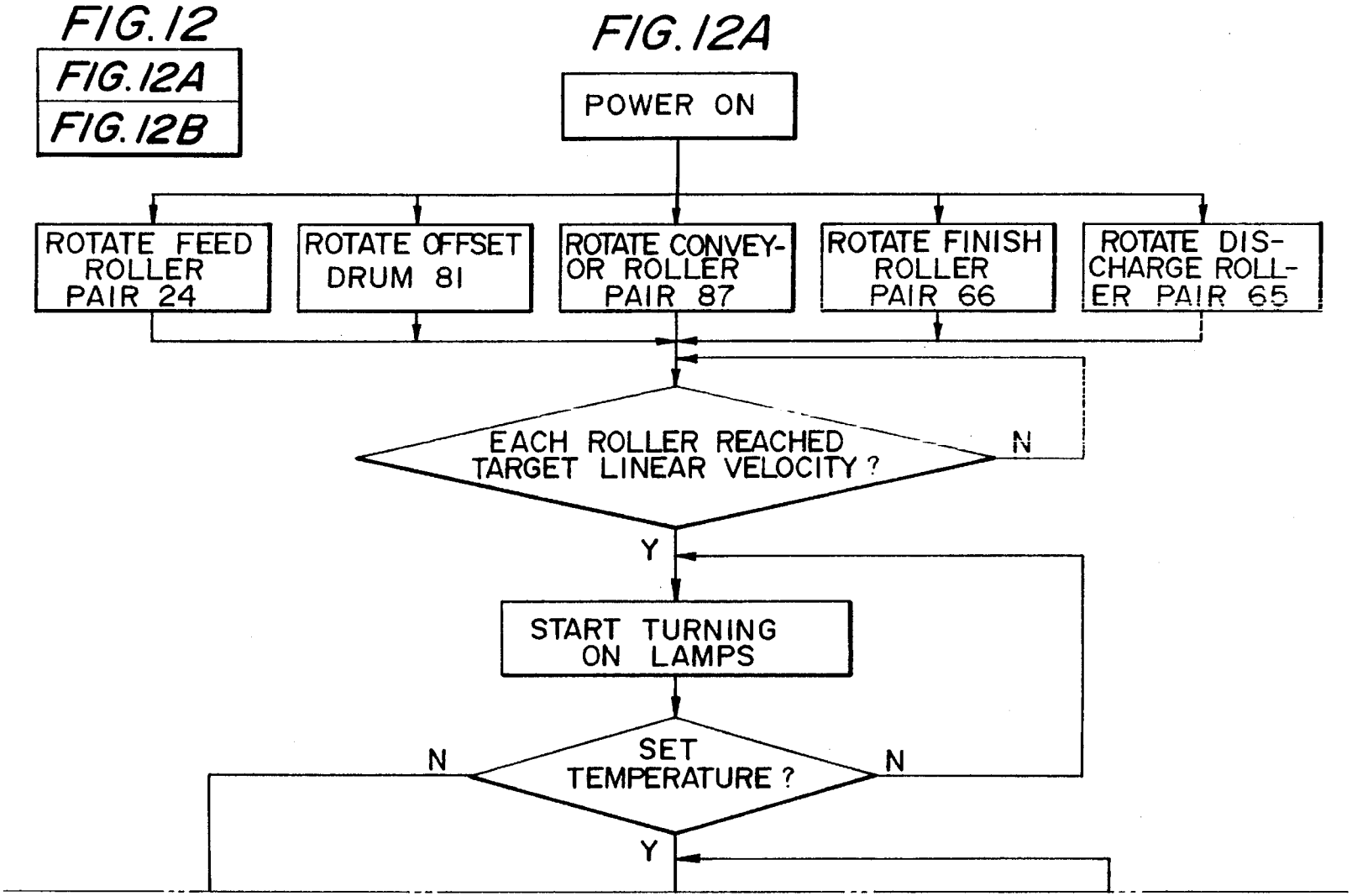
FIGS. 12A and 12B are a flowchart demonstrating a specific control procedure associated with the embodiment of FIG. 11.
Figure 12B:
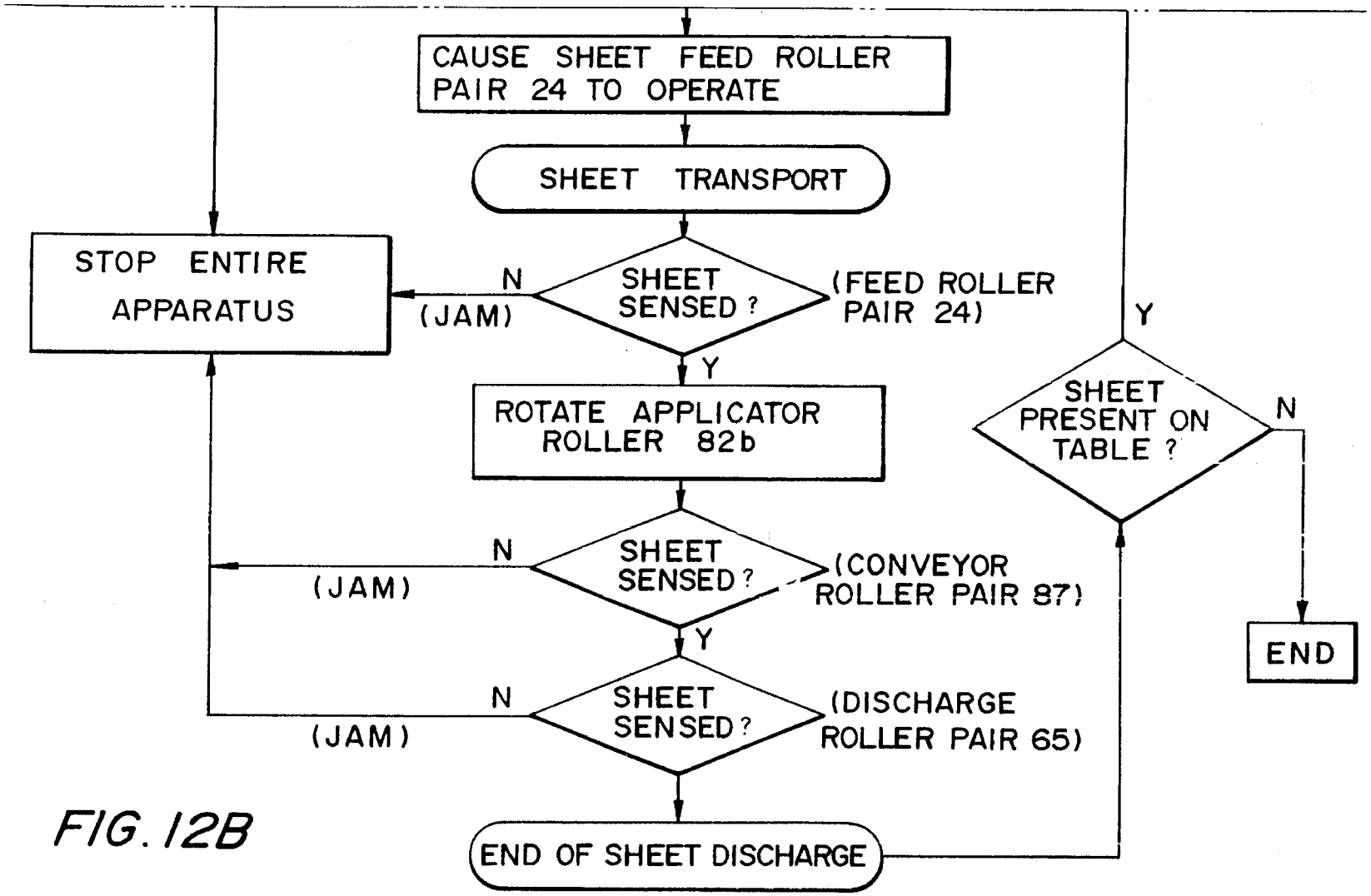

FIGS. 12A and 12B show a specific procedure for controlling the entire arrangement shown in FIG. 11. As shown, when the power source of the apparatus is turned on, the feed roller pair 24, offset drum 81, conveyor roller pair 87, finish roller pair 66 and discharge roller pair 65 start rotating. As soon as these roller pairs and drum each reaches the preselected rotation speed thereof, the lamps 84*a*, 81*a* and 66*a* are turned on. When all the objects heated by the respective lamps reach their preselected temperatures, the sheet feed unit 20 automatically starts feeding the sheets 10. When a sensor, not shown, determines that the leading edge of the sheet 10 has moved away from the feed roller pair 24, the applicator roller 82*b* starts rotating and supplying the liquid 31 to the drum 81. These roller pairs are continuously driven until the sheet 10 has been fully discharged, as determined by sensors associated with the conveyor roller pair 87 and discharge roller pair 65, respectively. On the completion of the sheet discharge, a sensor, not shown, determines whether or not any other sheets 10 are left on the sheet feed table 21. If no sheets 10 are left on the table 21, the procedure ends; if otherwise, the program returns to the sheet feed from the sheet feed unit 20. Assume that any one of the sheet sensors has sensed a jam while such an operation is under way, that overheat has occurred due to any one of the lamps, or that the liquid tank 82*c* has run out of the liquid and lowered the liquid level in the vessel 82*a* to prevent the applicator roller 82*c* from drawing up a sufficient amount of liquid. Then, the entire operation of the apparatus is interrupted, and the above occurrence is displayed, as needed.

As stated above, the embodiment supplies the liquid 31 to the sheet 10 and removes the toner from the sheet 10 while retaining the sheet 10 on the offset drum 8. Hence, the wet and softened sheet 10 can be conveyed stably during the course of such a procedure.

In the illustrative embodiment, the sheet 10 is wrapped around the offset drum 81 which has been supplied with the liquid 31 beforehand. Alternatively or in addition to this kind of scheme, the liquid may be supplied to the sheet 10, wrapped around the drum 81, from the surface of the sheet 10 opposite to the image surface. Specifically, liquid dropping means or liquid spraying means implemented by, for example, a syringe pump may be located above the part of the drum 81 moved away from the roller 83. In addition, mans may be provided for supplying, after the leading edge of the sheet 10 has wrapped around the drum 81, the liquid to the trailing portion of the drum sheet 10 from, for example, above the sheet 10.

The embodiments shown and described are constructed and arranged to remove almost all the toner from the sheet 10, thereby reproducing a blank sheet. However, heating the toner for softening it is not necessary when the present invention is implemented as a toner removing apparatus which has only to remove the toner to such a degree that the sheet is reusable as a simple scratch paper, a toner removing apparatus which is allowed to slightly damage the fibers of the sheet, a toner removing apparatus using a liquid which promotes toner separation from the sheet without resorting to the softening of the toner, and when a particular agent is used to soften the toner.

In summary, it will be seen that the present invention has various unprecedented advantages, as enumerated below.

(1) A sheet supplied with a liquid by liquid supplying means enters the nip portion of conveying means while being pulled toward opposite side edges in the widthwise direction by pulling means. Hence, the sheet infiltrated with a predetermined liquid can be conveyed without creasing in the longitudinal direction.

(2) Even when the thickness of the sheet is increased due to the infiltration of the liquid, it is not restricted by the surface of a liquid supply member and a sheet guide member. This allows a desired amount of liquid to be supplied to the sheet efficiently.

(3) Even when the surface of the liquid supply member is moved at a high speed for preventing the liquid from being exhausted, the sheet is prevented from being conveyed excessively downstream in the sheet transport direction. Therefore, the sheet infiltrated with the liquid can be transported without folding.

(4) Second conveying means is driven at a higher speed than first conveying means so as to convey the sheet while pulling it. This prevents the sheet infiltrated with the liquid from creasing in substantially the widthwise direction.

(5) The second conveying means is driven at a lower speed than the first conveying means. In this condition, even when the sheet is dried and contracted by the second conveying means, the sheet can be conveyed without an excessive degree of tension acting on the sheet between the trailing edge, nipped by the first conveying means, and the leading edge nipped by the second conveying means. It follows that the sheet infiltrated with the liquid is free from creases in the transport direction and breakage when it is transported while being heated.

(6) The sheet carrying an image forming substance thereon and supplied with the liquid is heated by a transfer member and a heat member each being heated to a predetermined temperature. In this condition, the substance on the sheet is heated to a higher temperature and softened more at the interface between the sheet and the substance than at the surface thereof contacting the surface of the transfer member. This promotes the transfer of the substance from the sheet to the transfer member and, therefore, allows the substance to be surely removed from the sheet without damaging the sheet.

(7) By pressing the sheet member widthwise by pressing means, it is possible to cause the liquid supplied to the sheet to positively infiltrate into the interface between the sheet and the substance. Hence, the substance can be surely removed from the sheet.

Various modifications will become possible for those skilled in the art after receiving the teachings of the present disclosure without departing front the scope thereof.

What is claimed is:

1. An apparatus for removing an image forming substance stably cohered to a surface of a sheet, comprising:

liquid supplying means for supplying a predetermined amount of a liquid to the sheet carrying the image forming substance;

conveying means for conveying the sheet supplied with the liquid along a transport path by nipping said sheet in a thickwise direction of said sheet;

removing means for removing the image forming substance from the sheet being conveyed by said conveying means, and further comprising drying means for drying the sheet from which the image forming substance has been removed by said removing means, wherein said drying means comprises heating means for heating the sheet, and a pressing member for pressing the sheet against said heating means and moving said sheet, wherein said liquid supplying means comprises a liquid supply member movable while retaining the liquid on a surface thereof, wherein said liquid supply member comprises a rotatable applicator roller and a sheet regulator roller, wherein said applicator roller and said sheet regulator roller are spaced apart from each other by a predetermined gap, and wherein said predetermined gap is greater than a thickness of the sheet which has been increased due to infiltration of the liquid.

2. An apparatus as claimed in claim 1, wherein said liquid supply means further comprises a vessel storing the liquid, and wherein said applicator roller being partly immersed in said liquid in said vessel.

3. An apparatus as claimed in claim 1, wherein said applicator roller is made of a material capable of retaining a liquid.

4. An apparatus as claimed in claim 1, wherein the liquid comprises water.

5. An apparatus as claimed in claim 1, wherein the liquid comprises an aqueous solution containing a surface active agent.

6. An apparatus as claimed in claim 1, wherein said liquid supplying means and said removing means are constructed into a single unit.

7. An apparatus as claimed in claim 1, further comprising first guide means for guiding the sheet to said liquid supplying means, and second guide for guiding said sheet supplied with the liquid to said removing means.

8. An apparatus for removing an image forming substance stably cohered to a surface of a sheet, comprising:

liquid supplying means for supplying a predetermined amount of a liquid to the sheet carrying the image forming substance;

conveying means for conveying the sheet supplied with the liquid along a transport path by nipping said sheet in a thicknesswise direction of said sheet; and removing means for removing the image forming substance from the sheet being conveyed by said conveying means, further comprising drying means for drying the sheet from which the image forming substance has been removed by said removing means, wherein said drying means comprises heating means for heating the sheet, and a pressing member for pressing the sheet against said heating means and moving said sheet.

9. An apparatus as claimed in claim 8, wherein said pressing means comprises a belt.

10. An apparatus as claimed in claim 9, wherein said belt moves at a speed lower than a speed at which the sheet is driven out of said removing means.

11. An apparatus as claimed in claim 9, wherein said belt comprises annular ridges formed at opposite widthwise side edges of an inner periphery thereof, said belt being passed over support rollers each being formed with circumferential grooves capable of receiving said annular ridges.

12. An apparatus for removing an image forming substance stably cohered to a surface of a sheet, comprising:

liquid supplying means for supplying a predetermined amount of a liquid to the sheet carrying the image forming substance;

conveying means for conveying the sheet supplied with the liquid along a transport path by nipping said sheet in a thicknesswise direction of said sheet; and removing means for removing the image forming substance from the sheet being conveyed by said conveying means, wherein said liquid supplying means comprises a liquid supply member movable while retaining the liquid on a surface thereof, wherein said liquid supply member comprises a rotatable applicator roller, wherein said conveying means comprises a first and a second conveyor member respectively positioned upstream and downstream of said applicator roller, and wherein said liquid supplying means further comprises control means for controllably driving said applicator roller such that after the sheet has faced said applicator roller and a trailing edge of said sheet has moved away from said first conveyor member, said applicator roller is rotated in a direction opposite to the direction of transport of said sheet.

13. An apparatus for removing an image forming substance stably cohered to a surface of a sheet, comprising:

liquid supplying means for supplying a predetermined amount of a liquid to the sheet carrying the image forming substance;

conveying means for conveying the sheet supplied with the liquid along a transport path by nipping said sheet in a thicknesswise direction of said sheet; and removing means for removing the image forming substance from the sheet being conveyed by said conveying means;

wherein said liquid supplying means comprises a liquid supply member movable while retaining the liquid on a surface thereof, wherein said liquid supply member comprises a rotatable applicator roller, and wherein said removing means comprises offset means for transferring the image forming substance from the sheet having been supplied with the liquid to a surface of said offset means, and heating means for pressing said offset means against the sheet while heating and softening the image forming substance.

14. An apparatus as claimed in claim 13, wherein said heating means comprises a heat lamp and a roller accommodating said heat lamp therein.

15. An apparatus as claimed in claim 14 wherein said heat lamp heats said offset means to a first temperature while heating said roller to a second temperature higher than said first temperature.

16. An apparatus for removing an image forming substance on a sheet by supplying a liquid to said sheet, comprising:

liquid supplying means movable while retaining the liquid on a surface thereof to thereby supply said liquid to a surface of the sheet; and conveying means for conveying the sheet supplied with the liquid along a transport path by nipping said sheet in a thicknesswise direction of said sheet, further comprising first guide means for guiding the sheet to said liquid supplying means, and second guide means for guiding said sheet supplied with the liquid to an outlet of said apparatus, wherein said liquid supplying means comprises a rotatable applicator roller, wherein said conveying means comprises a first and a second conveyor member respectively positioned upstream and downstream of said applicator roller, wherein said liquid supplying means further comprises control means for controllably driving said applicator roller such that after the sheet has faced said applicator roller and a trailing edge of said sheet has moved away from said first conveyor member, said applicator roller is rotated in a direction opposite to the direction of transport of said sheet.

17. An apparatus as claimed in claim 16, wherein said liquid supplying means further comprises pressing means for pressing the sheet supplied with the liquid in the thicknesswise direction to thereby cause the liquid to infiltrate into an interface between said sheet and said image forming substance.

* * * * *